US009390643B2

(12) United States Patent
Seder et al.

(10) Patent No.: US 9,390,643 B2
(45) Date of Patent: Jul. 12, 2016

(54) ROTATABLE ANIMATION DEVICES WITH STAGGERED ILLUMINATION SOURCES

(71) Applicants: Rufus Butler Seder, Arlington, MA (US); Gregg E. Favalora, Bedford, MA (US); Dexter Eames, Cambridge, MA (US)

(72) Inventors: Rufus Butler Seder, Arlington, MA (US); Gregg E. Favalora, Bedford, MA (US); Dexter Eames, Cambridge, MA (US)

( * ) Notice: Subject to any disclaimer, the term of this patent is extended or adjusted under 35 U.S.C. 154(b) by 521 days.

(21) Appl. No.: 13/927,106

(22) Filed: Jun. 25, 2013

(65) Prior Publication Data

US 2014/0152672 A1 Jun. 5, 2014

Related U.S. Application Data

(60) Provisional application No. 61/663,695, filed on Jun. 25, 2012.

(51) Int. Cl.
*G09G 3/00* (2006.01)
*G09G 3/32* (2016.01)

(52) U.S. Cl.
CPC . *G09G 3/005* (2013.01); *G09G 3/32* (2013.01)

(58) Field of Classification Search
CPC ..... G09G 3/005; G09G 3/32
See application file for complete search history.

(56) References Cited

U.S. PATENT DOCUMENTS 3,097,261 A 7/1963 Schipper
3,154,636 A 10/1964 Schwertz
3,202,985 A 8/1965 Perkins
3,204,238 A 8/1965 Skellett
4,160,973 A * 7/1979 Berlin, Jr. ..... G02B 27/2285 345/110
4,573,048 A 2/1986 Dash
4,689,604 A 8/1987 Sokol
5,057,827 A * 10/1991 Nobile ..... G09G 3/005 345/31
5,663,740 A * 9/1997 Brotz ..... G02B 27/2285 345/31
5,791,966 A 8/1998 Capps
6,064,423 A 5/2000 Geng
6,115,006 A 9/2000 Brotz (Continued)

FOREIGN PATENT DOCUMENTS

CN 2785083 5/2006

OTHER PUBLICATIONS

Monkeylectric, Monkey Light Pro—Bicycle Wheel Display System, Kickstarter project description (Internet), date of publication unknown, retrieved Jul. 18, 2013, 34 pages, www.kickstarter.com, San Francisco, CA, USA.

*Primary Examiner* — Charlie Y Peng
(74) *Attorney, Agent, or Firm* — Thomas P. O'Connell; O'Connell Law Firm

(57) ABSTRACT

An illuminated animation device with staggered sources of illumination with a rotatable member rotatable about an axis of rotation, first and second pluralities of sources of illumination retained to rotate with the rotatable member that are actuatable between illuminated and non-illuminated conditions. The first and second pluralities of sources of illumination are staggered so that the sources of illumination will produce individual paths of illumination to permit image display with enhanced. The rotatable member can be a rotatable panel with first and second arrays retained relative to first and second halves thereof, and the sources of illumination can be longitudinally and laterally staggered, such as by one-half a distance between adjacent sources of illumination. The sources of animation can alternatively be disposed in opposed, radially spaced straight line arrays. The device can be handheld and can include a motor and a power source.

25 Claims, 30 Drawing Sheets

(56) References Cited

U.S. PATENT DOCUMENTS 6,265,984 B1 7/2001 Molinaroli
6,278,419 B1 * 8/2001 Malkin ..... H04N 13/0493 345/31
6,335,714 B1 * 1/2002 Wang ..... G09G 3/005 345/31
6,801,185 B2 10/2004 Salley
7,099,701 B2 * 8/2006 Lo ..... G09F 9/33 345/82
7,250,954 B2 * 7/2007 Biegelsen ..... G02B 27/2285 345/589
7,397,387 B2 7/2008 Suzuki
7,477,208 B2 1/2009 Matlock
7,708,640 B2 5/2010 Burak et al.
7,847,756 B2 12/2010 Ishibashi
2002/0135541 A1 * 9/2002 Kowalewski ..... G09G 3/005 345/31
2003/0080924 A1 * 5/2003 Bentley ..... G09F 9/33 345/31
2009/0133299 A1 * 5/2009 Blackwell ..... G09F 21/10 40/212
2010/0097448 A1 * 4/2010 Gilbert ..... B60K 35/00 348/51
2010/0171681 A1 7/2010 Cabanas et al.
2013/0229392 A1 * 9/2013 Weiss ..... G06F 3/03545 345/179

* cited by examiner

Cont'

Cont'

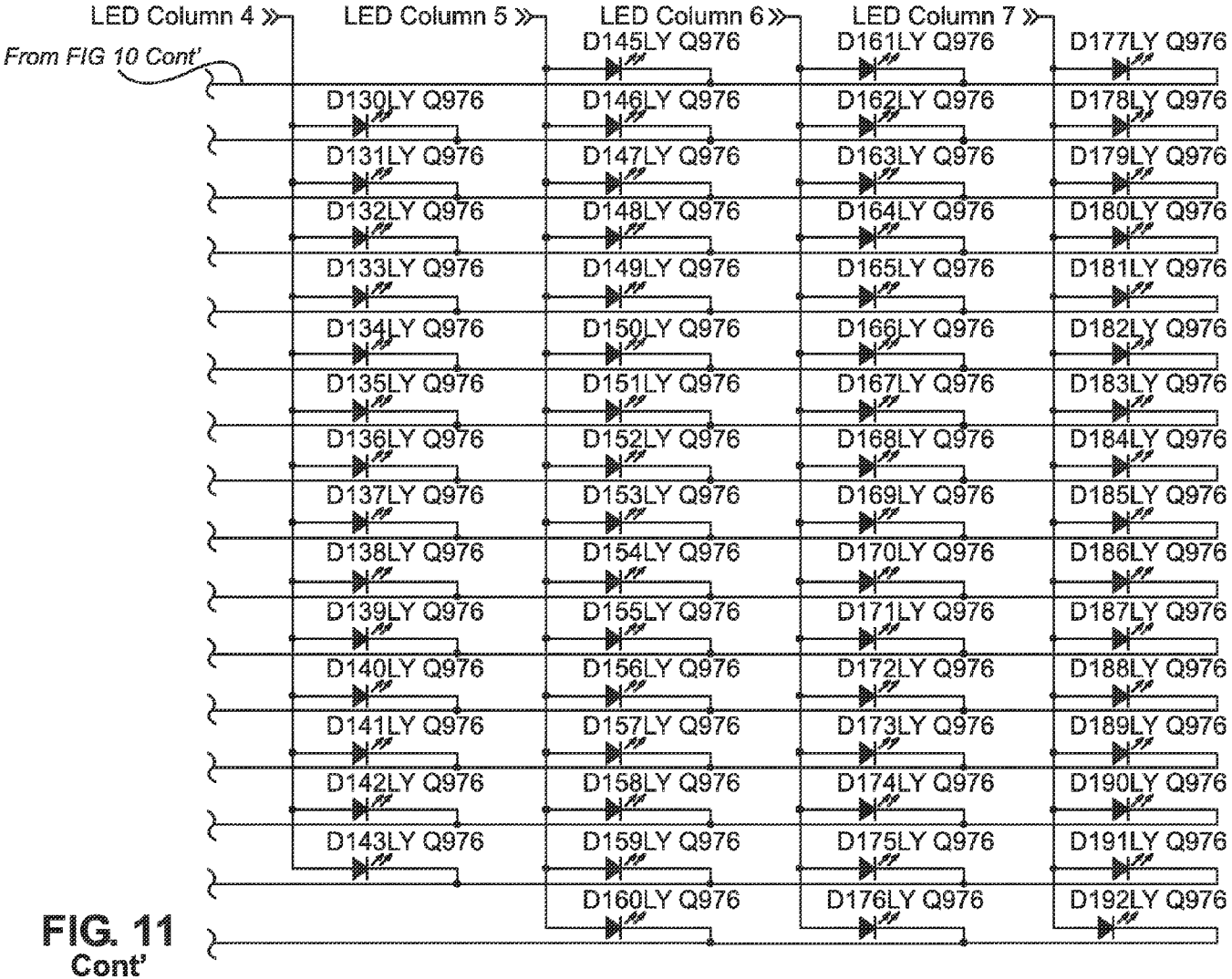
FIG. 11 Cont'

| DRILL CHART | | | | |
|---|---|---|---|---|
| SYM | DIAM | TOL | QTY | NOTE |
| ⊘ | 0.012 | | 29 | |
| + | 0.030 | | 10 | |
| ⊠ | 0.077 | | 1 | |
| TOTAL | | | 40 | |

Cont'

Mapping bits to LEDs

How data is stored in file

| | p | o | n | m | l | k | j | i | h | g | f | e | d | c | b | a |
|---|---|---|---|---|---|---|---|---|---|---|---|---|---|---|---|---|
| Example: 0x0001 | 0 | 0 | 0 | 0 | 0 | 0 | 0 | 0 | 0 | 0 | 0 | 0 | 0 | 0 | 0 | 1 |
| Example: 0x0002 | 0 | 0 | 0 | 0 | 0 | 0 | 0 | 0 | 0 | 0 | 0 | 0 | 0 | 0 | 1 | 0 |
| Example: 0x8000 | 1 | 0 | 0 | 0 | 0 | 0 | 0 | 0 | 0 | 0 | 0 | 0 | 0 | 0 | 0 | 0 |

Which bits light which LEDs

| | | | | | | | | innermost | | | | | | | | outermost |
|---|---|---|---|---|---|---|---|---|---|---|---|---|---|---|---|---|
| | -0.87 | -0.75 | -0.63 | -0.51 | -0.39 | -0.27 | -0.15 | -0.03 | 0.09 | 0.21 | 0.33 | 0.45 | 0.57 | 0.69 | 0.81 | 0.93 |
| Fill in with letters: | i | j | k | l | m | n | o | p | a | b | c | d | e | f | g | h |

FIG. 24

ROTATABLE ANIMATION DEVICES WITH STAGGERED ILLUMINATION SOURCES

Provisional Application No. 61/663,695, filed Jun. 25, 2012

FIELD OF THE INVENTION

The present invention relates generally to display devices. More particularly, disclosed herein are rotatable animation devices with staggered illumination sources for producing illuminated animation, potentially in a handheld, mobile device, with enhanced resolution.

BACKGROUND OF THE INVENTION

The prior art has disclosed numerous two-dimensional illuminated displays. For instance, information and entertainment displays have been disclosed with linear and two-dimensional arrays of selectively activated light sources, such as light-emitting diodes (LEDs). Two-dimensional arrays of light sources are typically arranged in a planar configuration. A display may thus be created by selectively illuminating the light sources. In certain instances, the arrays may be movable thereby to increase the display effect. By way of example, devices of the prior art have disposed linear and two-dimensional arrays of light sources on flat and sometimes arcuate or cylindrical rotatable members, such as fan blades, rotating drums, and other structures whereby messages and animated images can be displayed over a range of angles. While advantageous in certain applications, two-dimensional arrays are obviously limited in their ability to display images and information.

Accordingly, further teachings of the prior art have sought to provide three-dimensional displays, such as by use of a two-dimensional array of light sources disposed on a rotatable panel. The array can then be rotated about a central axis while the light sources are activated in sequence and at an effective rate thereby to present an image to a viewer. The image can be a moving image or a fixed image, each being perceived by the viewer as a result of the persistence of vision phenomenon associated with the human eye. Such rotating, three-dimensional displays can provide enhanced detail to the viewer and are commonly considered to have greater appeal aesthetically and for conveying advertising and information. When such three-dimensional displays are interfaced with electronic controls, a variable three-dimensional image can be created with a degree of complexity. Such displays can be exploited for numerous purposes, including entertainment, education, and conveying three-dimensional data, such as in the fields of medicine, non-destructive testing, air traffic control, and computer aided design.

One of the earliest volumetric three-dimensional displays was designed by Schipper and was protected by U.S. Pat. No. 3,097,261. There, a rotating electroluminescent panel has an embedded high-speed light emitter array. With that, by controlling the timing of the x-y addressing of the light emitter array and the rotation of the panel, three-dimensional images can be formed within the volume swept by the rotating panel. Further three-dimensional display devices with an array of light sources retained on a rotatable flat panel are found, for example, in U.S. Pat. No. 3,154,636 to Schwertz and in the U.S. Pat. No. 4,160,973 to Berlin. Berlin sought to develop an approach to solve a recognized high-bandwidth data transmission problem using an optical link and exploiting a high speed LED matrix with the LEDs again rotated to sweep out a three-dimensional volume. A curved rotatable screen is taught in U.S. Pat. No. 3,204,238 to Skellet, and a spherical spiral screen is used in U.S. Pat. No. 3,202,985 to Perkins, both disclosed for use as radar displays. In each instance, when the panel is rotated and the light sources selectively illuminated, the two-dimensional array produces volumetric, three-dimensional displays.

In each of these systems, the resolution of the two-dimensional image or, as applicable, the three-dimensional volume is inherently limited by the number and density of LEDs or other light sources that are rotated to produce the two-dimensional or three-dimensional image. Even where light sources are disposed to opposed sides of an axis of rotation seeking to produce brighter and crisper animation, corresponding light sources will tend to travel along the same illumination paths. Therefore, while there may actually be multiple light sources in a given illumination path, the light sources will not yield an increase in the resolution of the animation provided by the system.

SUMMARY OF THE INVENTION

With an understanding of the foregoing, the present invention was founded on the object of providing rotatable animation devices with illuminated animation of enhanced resolution and clarity.

A related object of the invention is to provide a rotatable animation device where light sources have distinct paths of illumination thereby to provide greater resolution in the depicted image.

Embodiments of the invention have the further object of producing illuminated animation in a handheld device.

Certain embodiments of the invention seek to provide illuminated animation with greater resolution in two dimensions while others seek to provide three-dimensional animation of enhanced resolution.

These and further objects and advantages of embodiments of the invention will become obvious not only to one who reviews the present specification and drawings but also to those who have an opportunity to enjoy the use of an embodiment of the rotatable animation devices with staggered illumination sources disclosed herein. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In one embodiment, the illuminated animation device with staggered sources of illumination is founded on a rotatable member rotatable about an axis of rotation. First and second pluralities of sources of illumination are retained to rotate with the rotatable member. The first and second pluralities of sources of illumination are actuatable between illuminated and non-illuminated conditions, and the first plurality of sources of illumination are staggered in relation to the second sources of illumination. Under this construction, when the rotatable member is rotated and the sources of illumination are actuated, the sources of illumination will produce paths of illumination. The paths of illumination produced by the first plurality of sources of illumination are advantageously staggered in relation to the paths of illumination produced by the second plurality of sources of illumination. As a result, illuminated images, whether in two or three dimensions, can be displayed by the illuminated animation device with a resolution deriving from the paths of illumination of both the first and second pluralities of sources of illumination.

In certain embodiments, the rotatable member can take the form of a rotatable panel with a longitudinal axis of rotation. A first panel half is disposed to one side of the longitudinal axis of rotation, and a second panel half is disposed to a second side of the longitudinal axis of rotation. The first plurality of sources of illumination are retained in a longitudinally and laterally spaced array by the first panel half, and the second plurality of sources of illumination are retained in a longitudinally and laterally spaced array by the second panel half. With this, the illuminated animation device can produce three-dimensional images and animation by a rotation of the rotatable panel in combination with an actuation of the first and second pluralities of sources of illumination. As disclosed herein, the first plurality of sources of illumination can be longitudinally, laterally, or laterally and longitudinally staggered in relation to the second plurality of sources of illumination.

With or without such a rotatable panel, the first plurality of sources of illumination can be retained in a longitudinally and laterally spaced array, and the second plurality of sources of illumination can be retained in a longitudinally and laterally spaced array spaced from the array of the first plurality of sources of illumination. The first and second pluralities of sources of illumination in such embodiments can be rotatable about a longitudinal axis of rotation whereby the illuminated animation device can produce three-dimensional images and animation by a rotation of the rotatable member in combination with an actuation of the first and second pluralities of sources of illumination. While it need not necessarily be the case, the array of the first plurality of sources of illumination can be disposed substantially in diametric opposition to the array of the second plurality of sources of illumination. The first and second pluralities of sources of animation can be approximately equal in number, and the first and second pluralities of sources of illumination can be disposed in substantially matching patterns. For instance, the first and second pluralities of sources of illumination can be substantially evenly spaced, and the first and second pluralities of sources of illumination can be staggered in lateral and longitudinal positions by approximately one-half a distance between adjacent sources of illumination.

In other embodiments, the first plurality of sources of illumination can be retained in a radially spaced array, such as a substantially straight line, and the second plurality of sources of illumination can likewise be retained in a radially spaced array, again potentially in a straight line, but spaced from the array of the first plurality of sources of illumination. So configured, the illuminated animation device can produce two-dimensional images and animation by a rotation of the rotatable member in combination with an actuation of the first and second pluralities of sources of illumination. Again, the array of the first plurality of sources of illumination can be disposed substantially in diametric opposition to the array of the second plurality of sources of illumination. Moreover, the pluralities of sources of illumination in each array can be substantially evenly spaced and staggered in radial position by approximately one-half a distance between adjacent sources of illumination. With that, the paths of illumination established by the first plurality of sources of illumination will be interposed between the paths of illumination established by the second plurality of sources of illumination. Such embodiments could take the form of a rotatable fan blade or other member, a manually rotatable top, or any other construction except as the invention might be limited by the claims. Where the animation device takes the form of a top, it can be calibrated to have a rate of playback of animated images as a function of the actual or estimated angular velocity of the top.

It is contemplated that a circuit board can be retained to rotate with the rotatable member, and a motor can be disposed, for instance, in a handle portion of the device for rotating the rotatable member. A power source, such as a battery, can be provided for powering the motor.

In still other embodiments, the rotatable member can be rotatable about first and second axes of rotation. The first plurality of sources of illumination can again be retained in a radially spaced array, and the second plurality of sources of illumination can again be retained in a radially spaced array spaced from the array of the first plurality of sources of illumination. With this, the illuminated animation device can produce three-dimensional volumetric images and animation by a rotation of the rotatable member about the first and second axes of rotation in combination with an actuation of the first and second pluralities of sources of illumination.

As noted, the illuminated animation device can be handheld. In such constructions, it can have a handle portion that rotatably retains the rotatable member. A motor can be provided for rotating the rotatable member, and a power source can be incorporated for powering the motor. A user control interface can be included for permitting selective control of, for instance, the rotation of the rotatable member, the illumination of the sources of illumination, and the animation speed of three-dimensional animation displayed by the animation device. A power circuit board can be retained by the handle portion, a display circuit board can be retained to rotate with the rotatable member, and rotary electrical interfaces can transmit power and control signals between the power circuit board and the display circuit board. Further, a memory chip can be retained to rotate with the rotatable member, a data connector can permit loading data files onto the memory chip, and a programming connector can rotate with the rotatable member to permit a programming of the display circuit board. Still further, the device can incorporate means for adjusting the brightness of the sources of illumination dependent on a distance of the source of illumination from the axis of rotation.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

Figure 1:
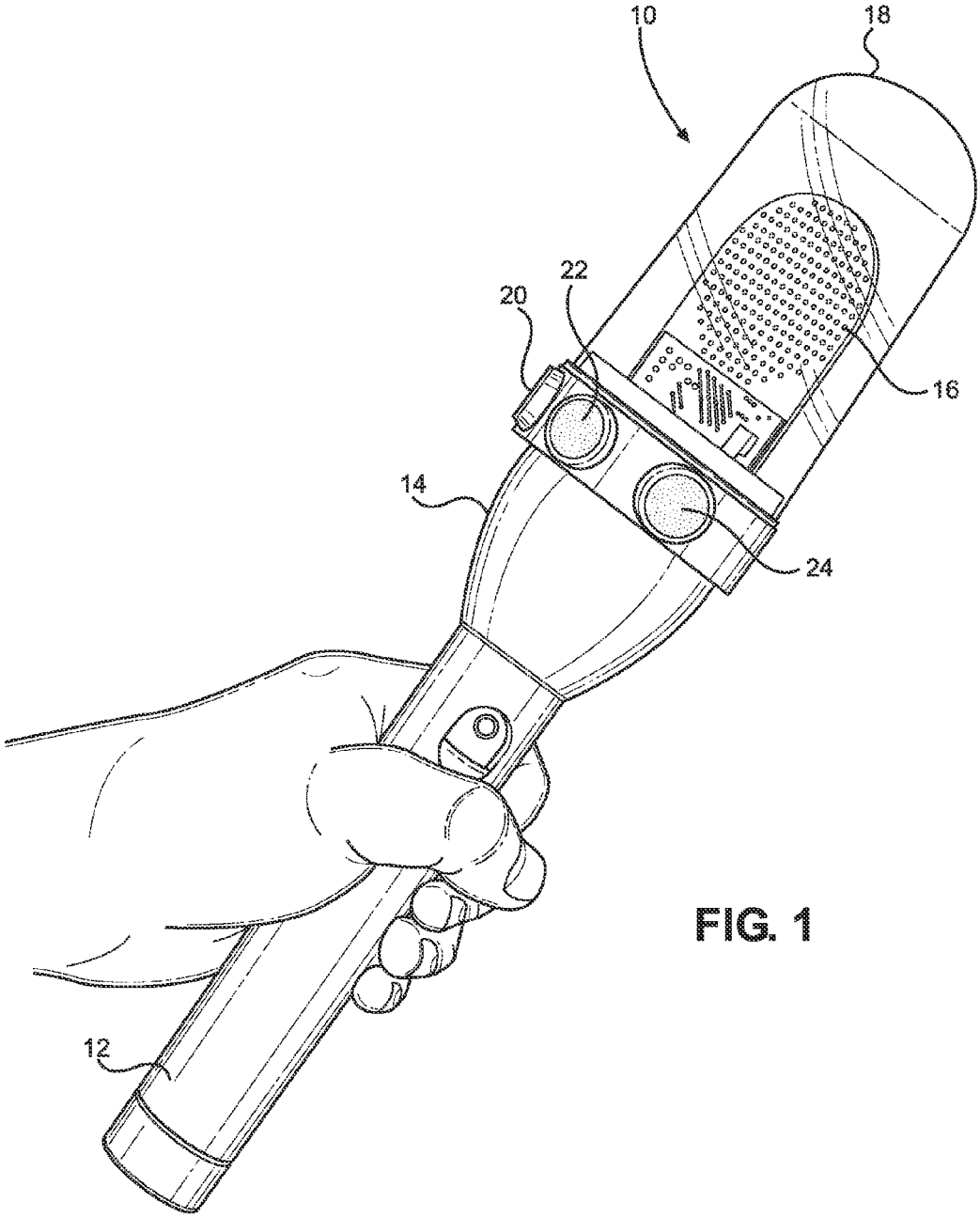
FIG. 1 is a perspective view of an illuminated three-dimensional animation device pursuant to the present invention.
Figure 6:
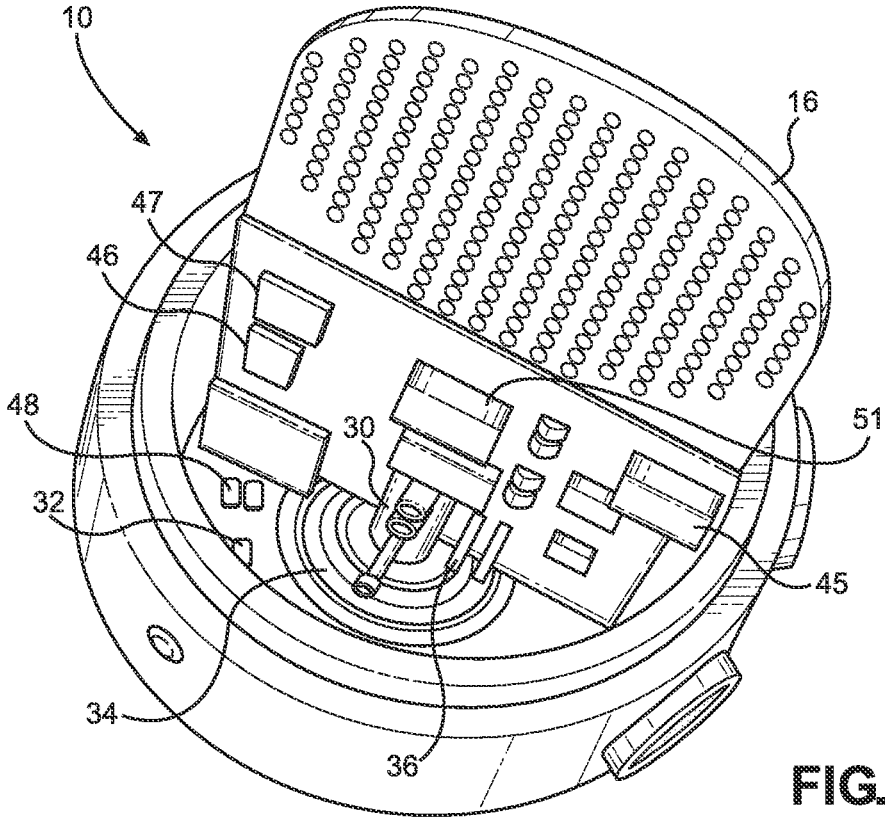
Figure 7:
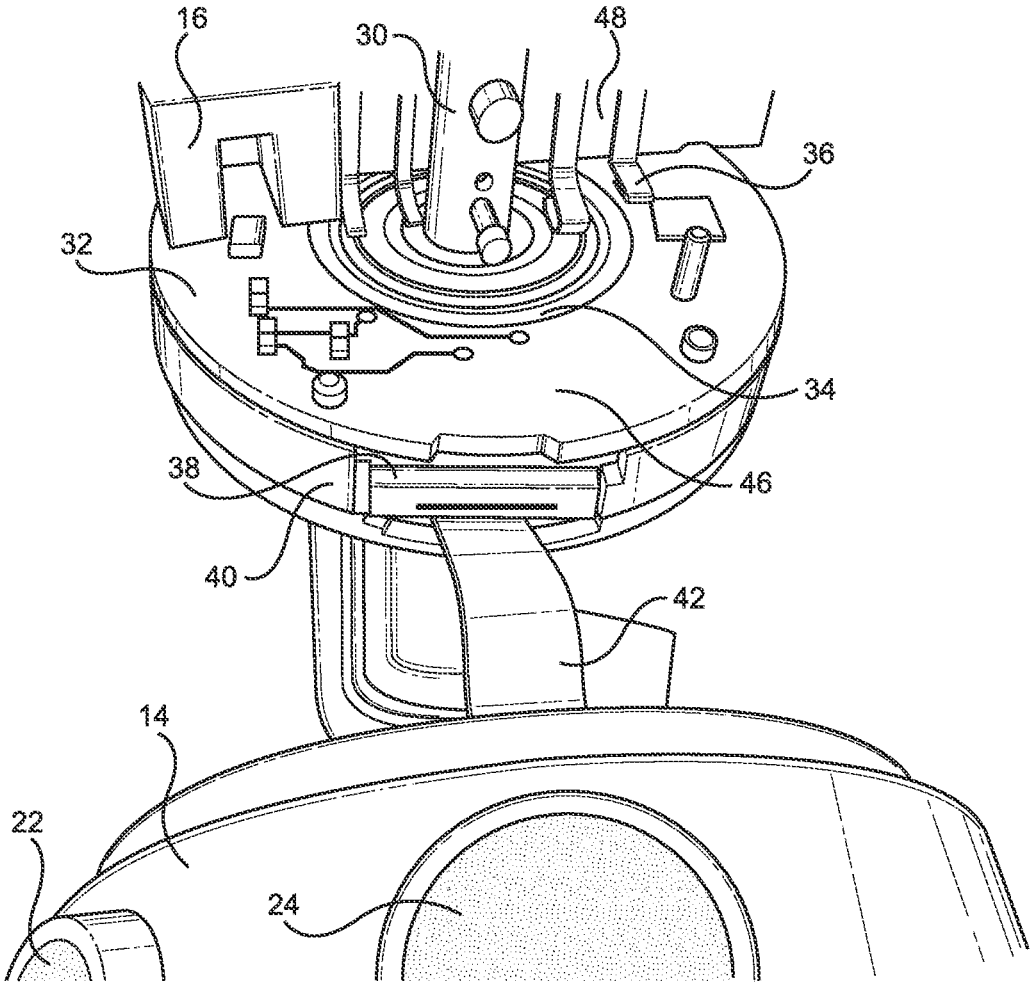
Figure 8:
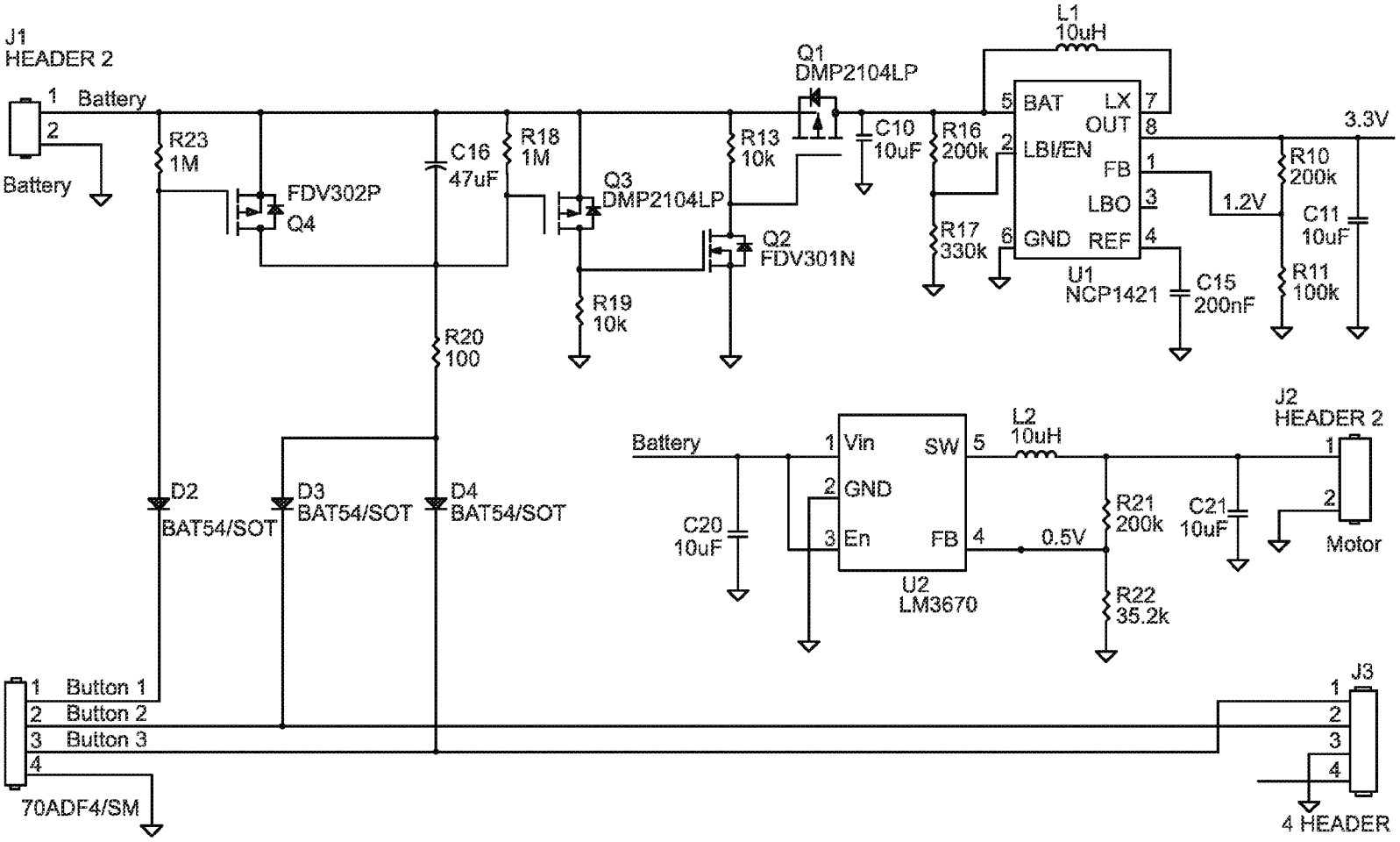
Figure 9:
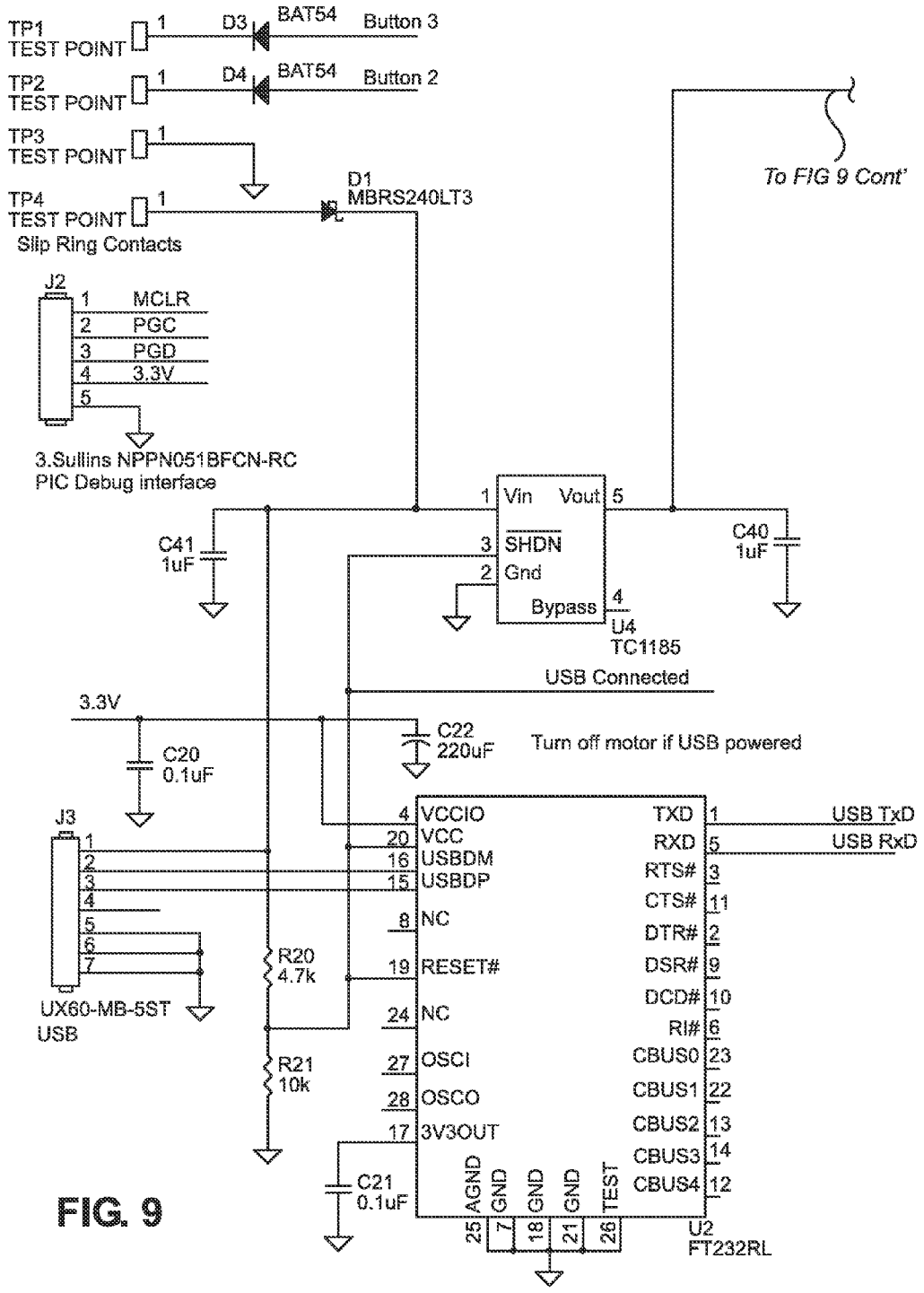
Figure 9:
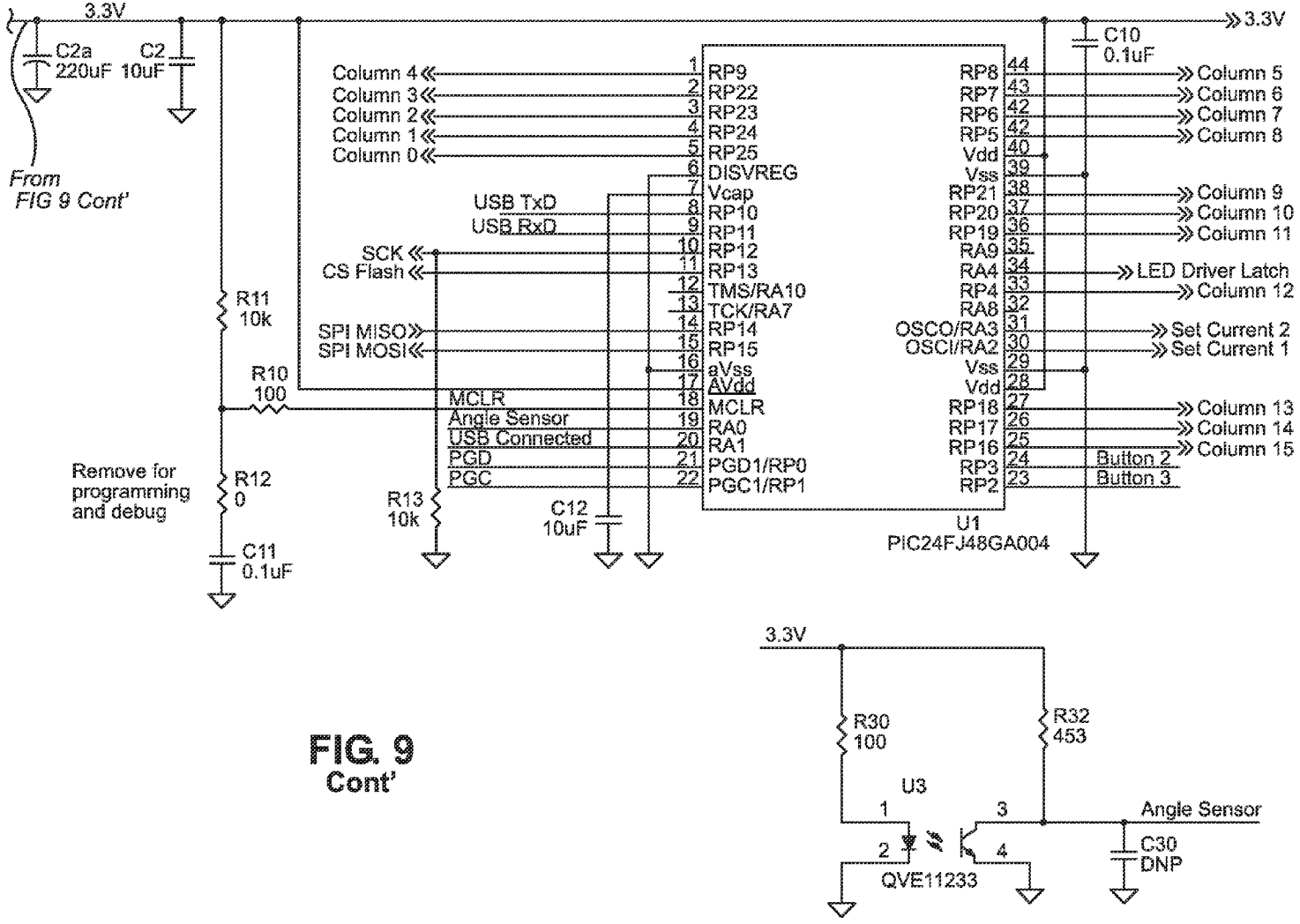
Figure 10:
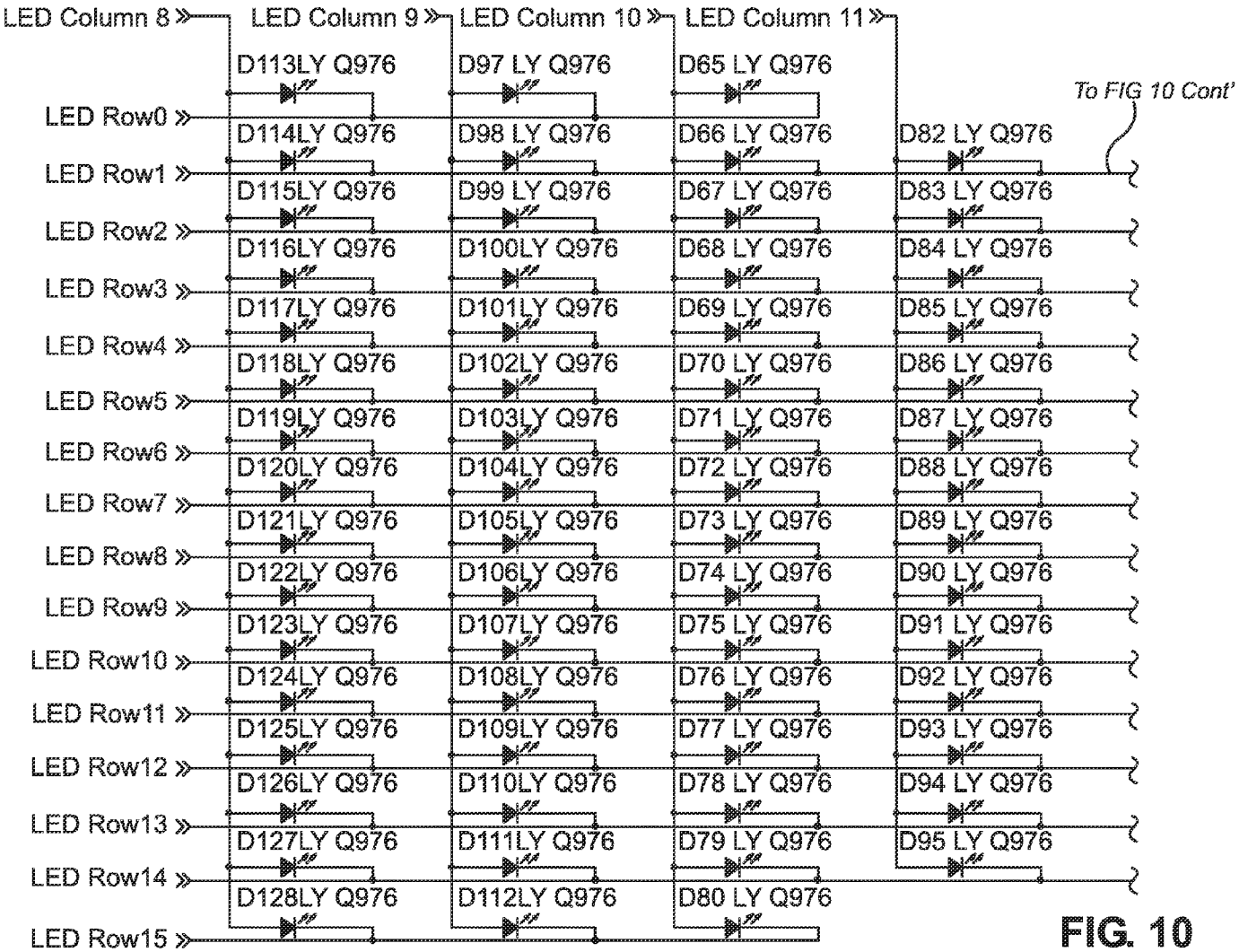
Figure 10:
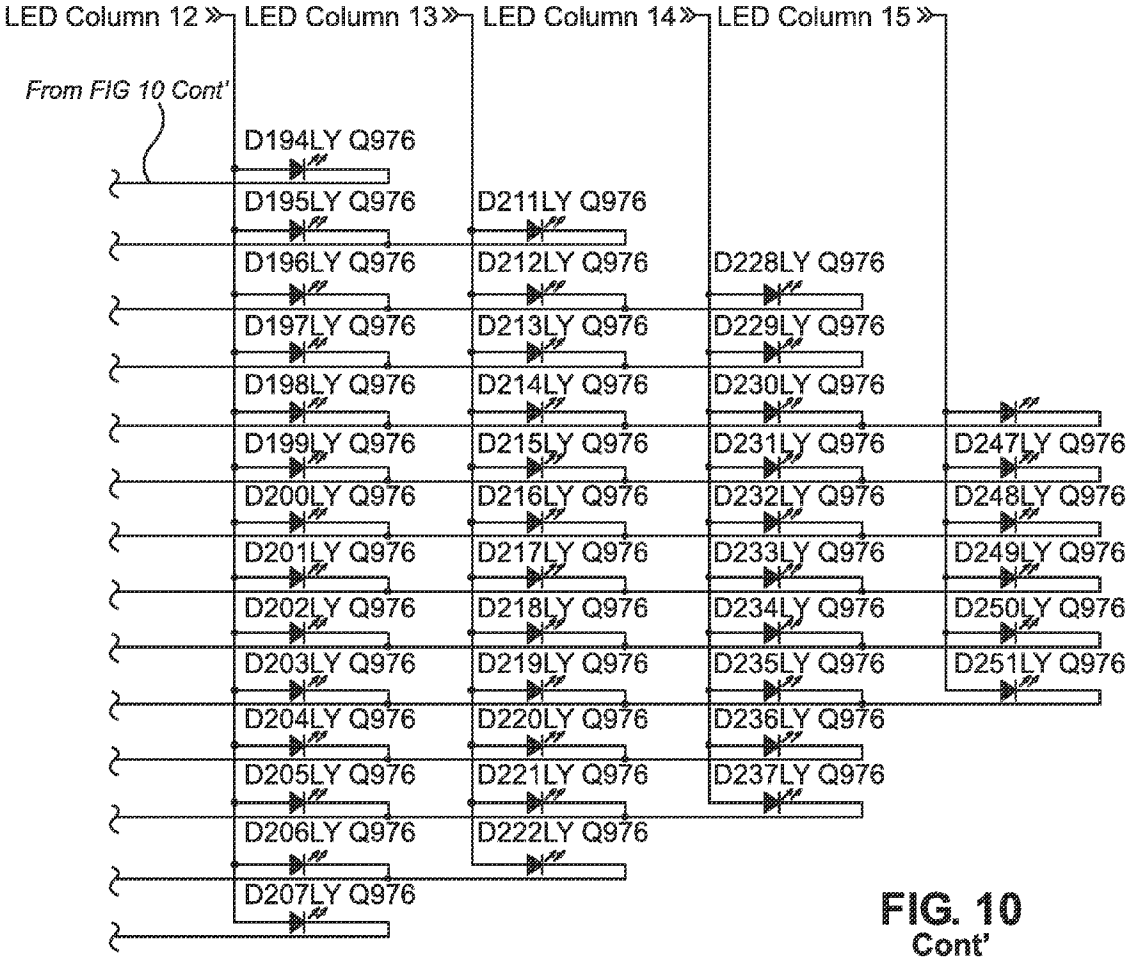
Figure 11:
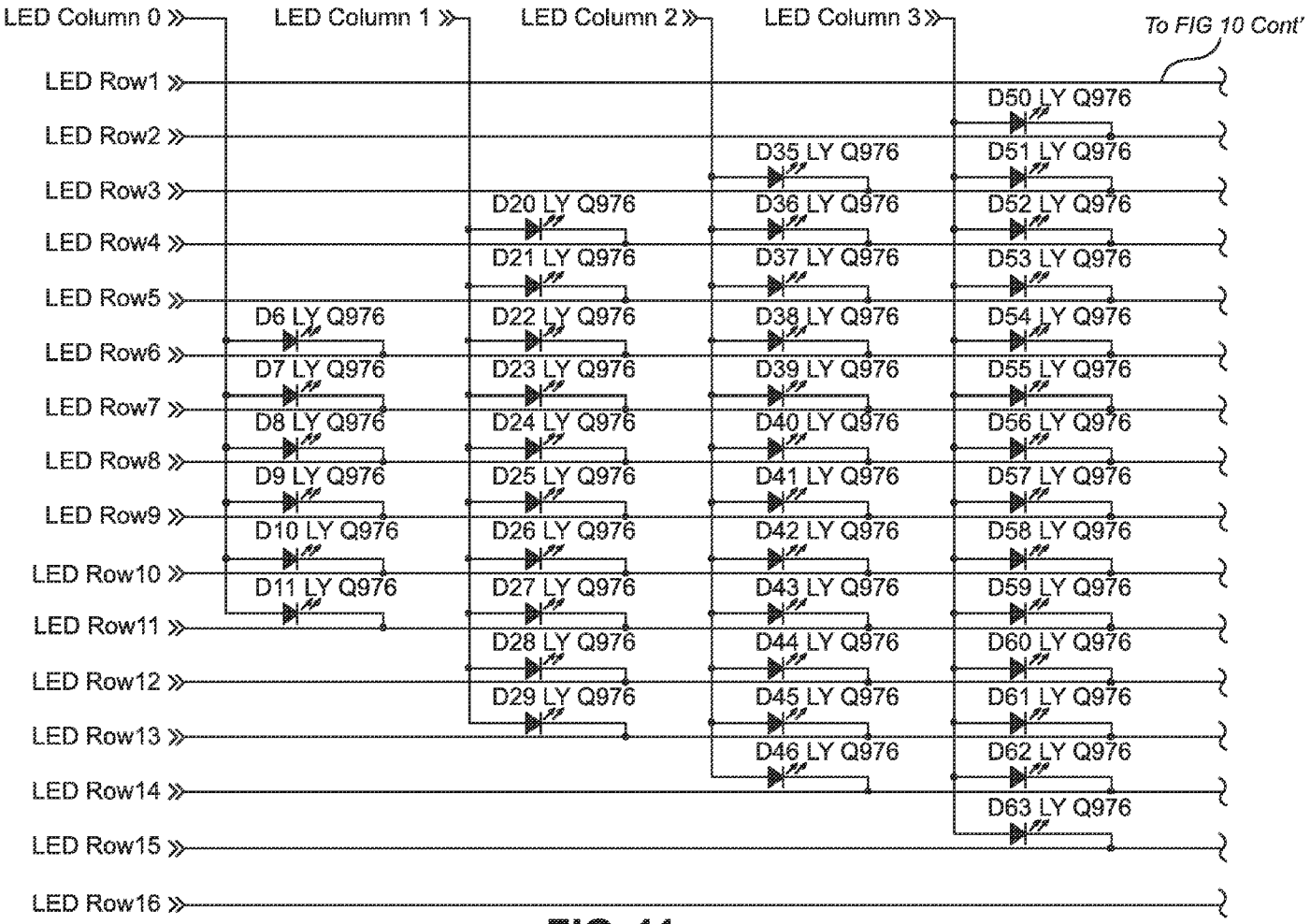
Figure 12A:
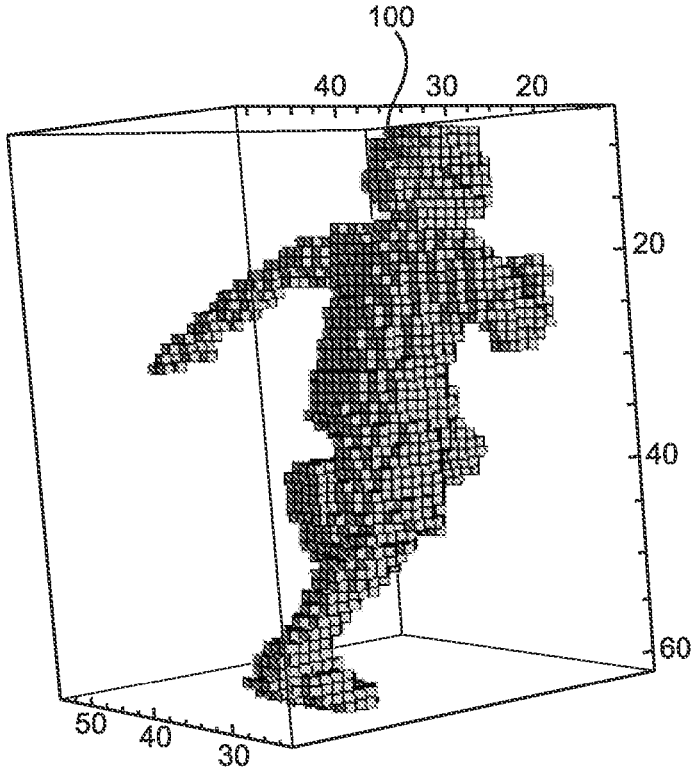
Figure 12B:
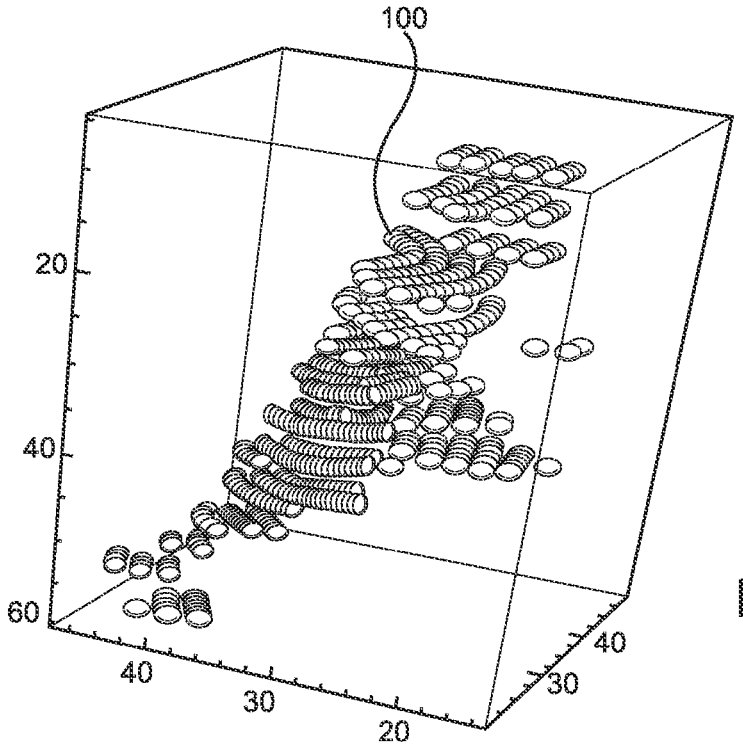
Figure 12C:
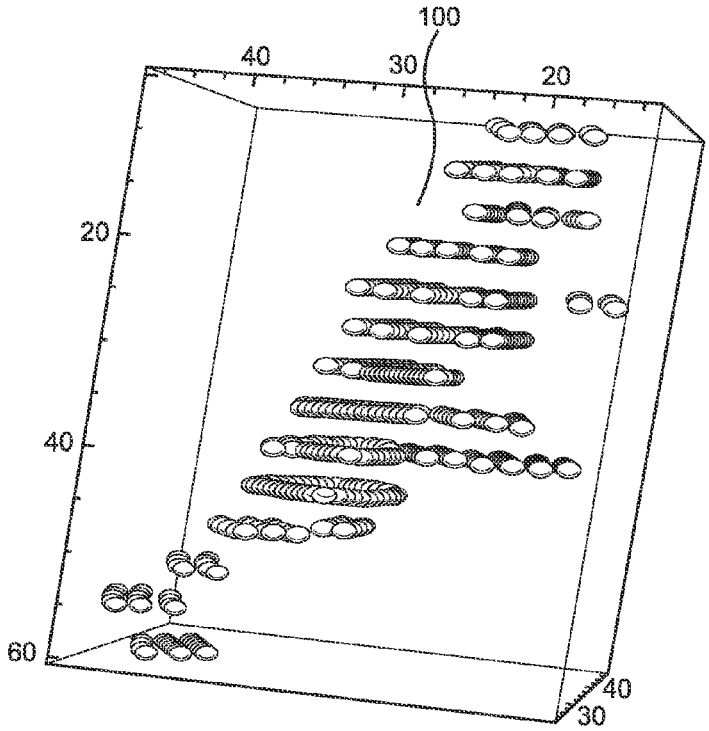
Figure 12D:
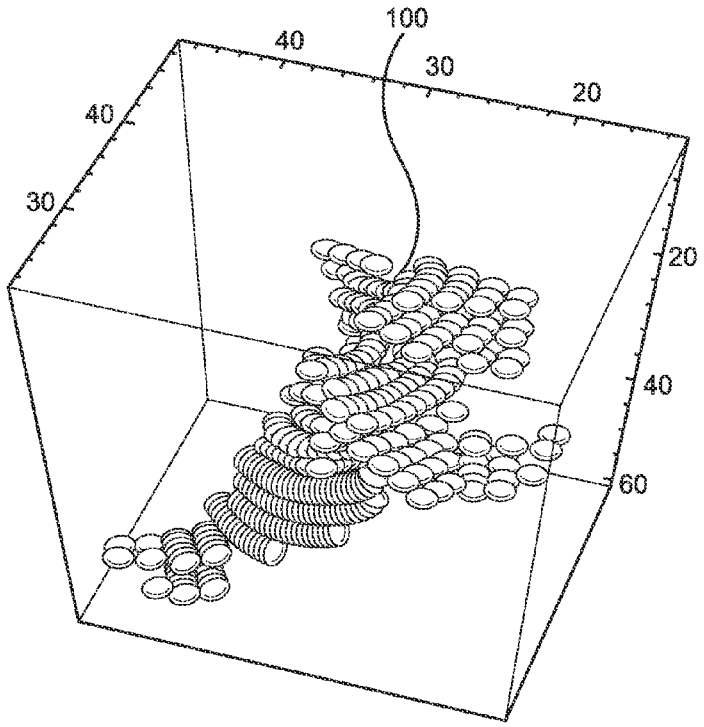
Figure 13A:
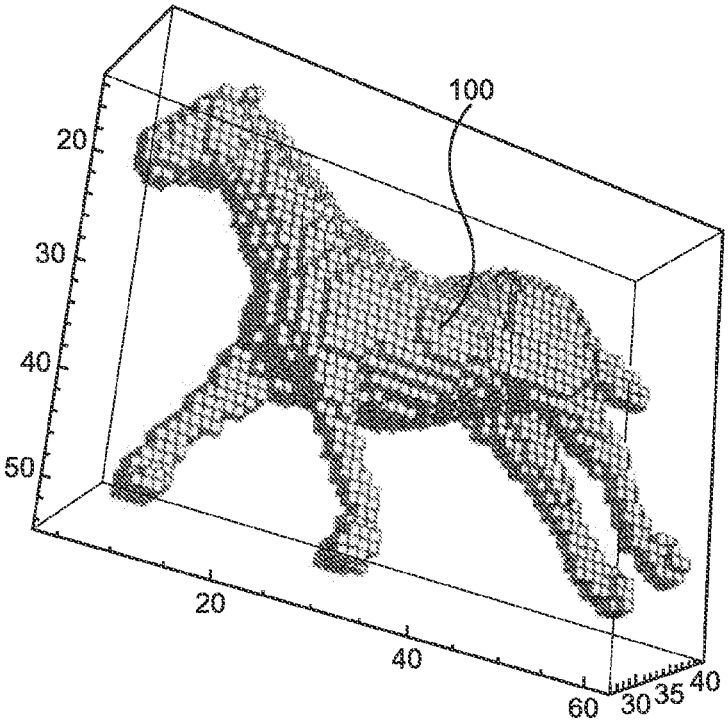
Figure 13B:
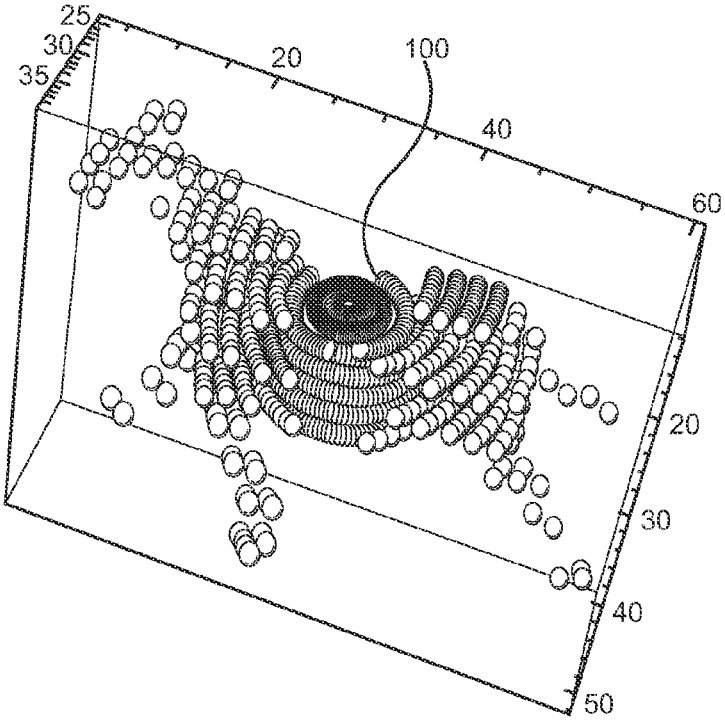
Figure 13C:
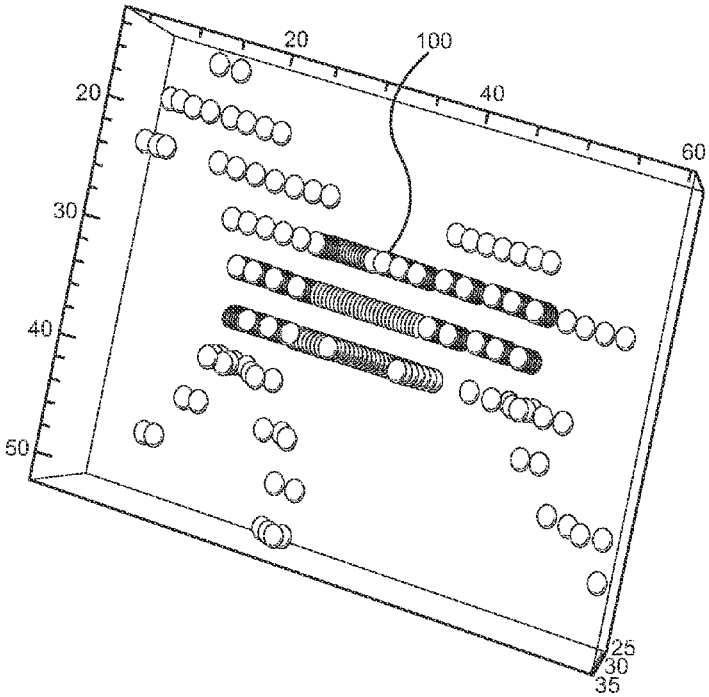
Figure 14A:
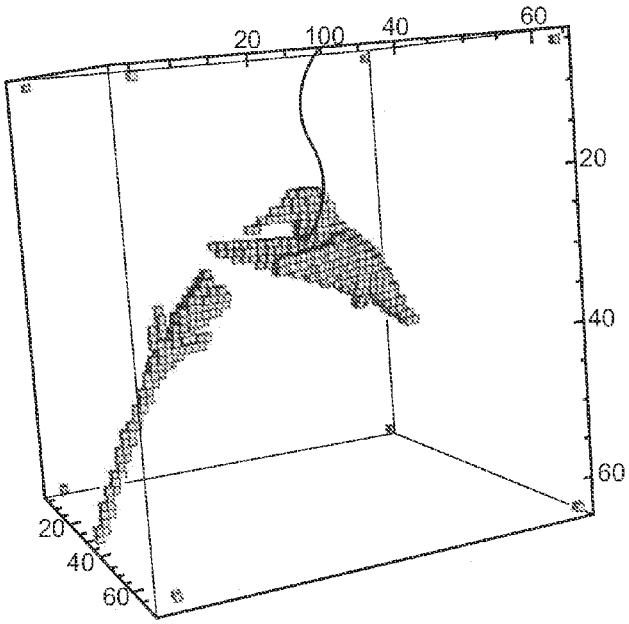
Figure 14B:
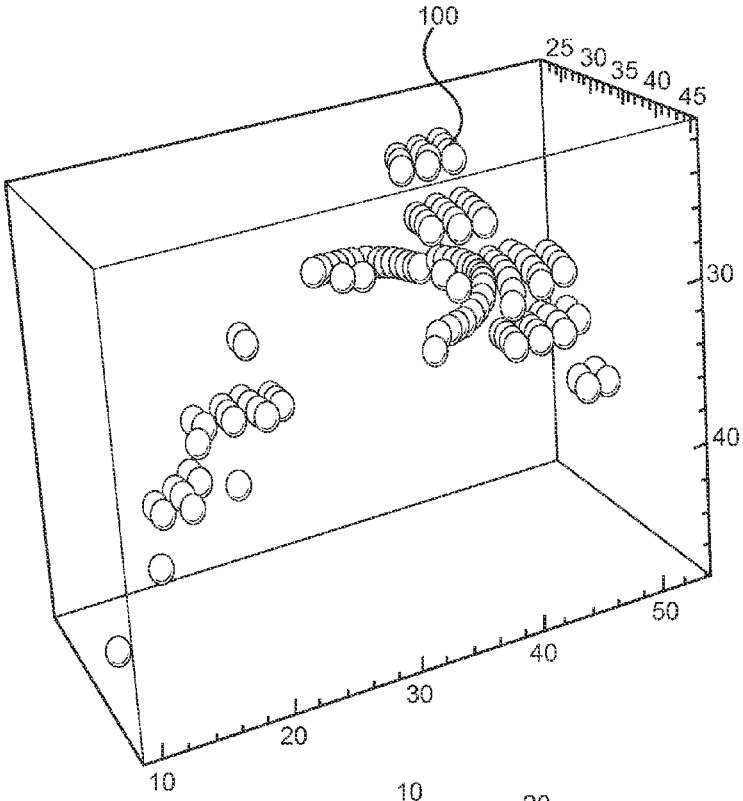
Figure 14C:
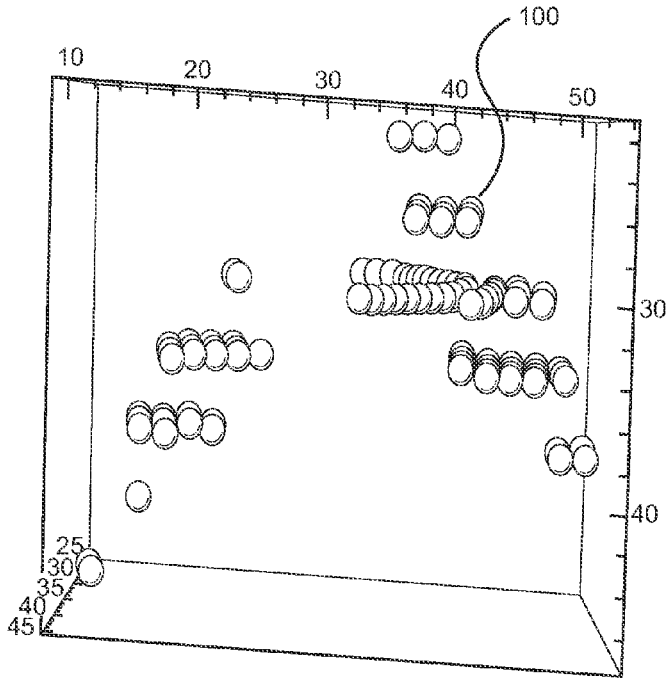
Figure 15:
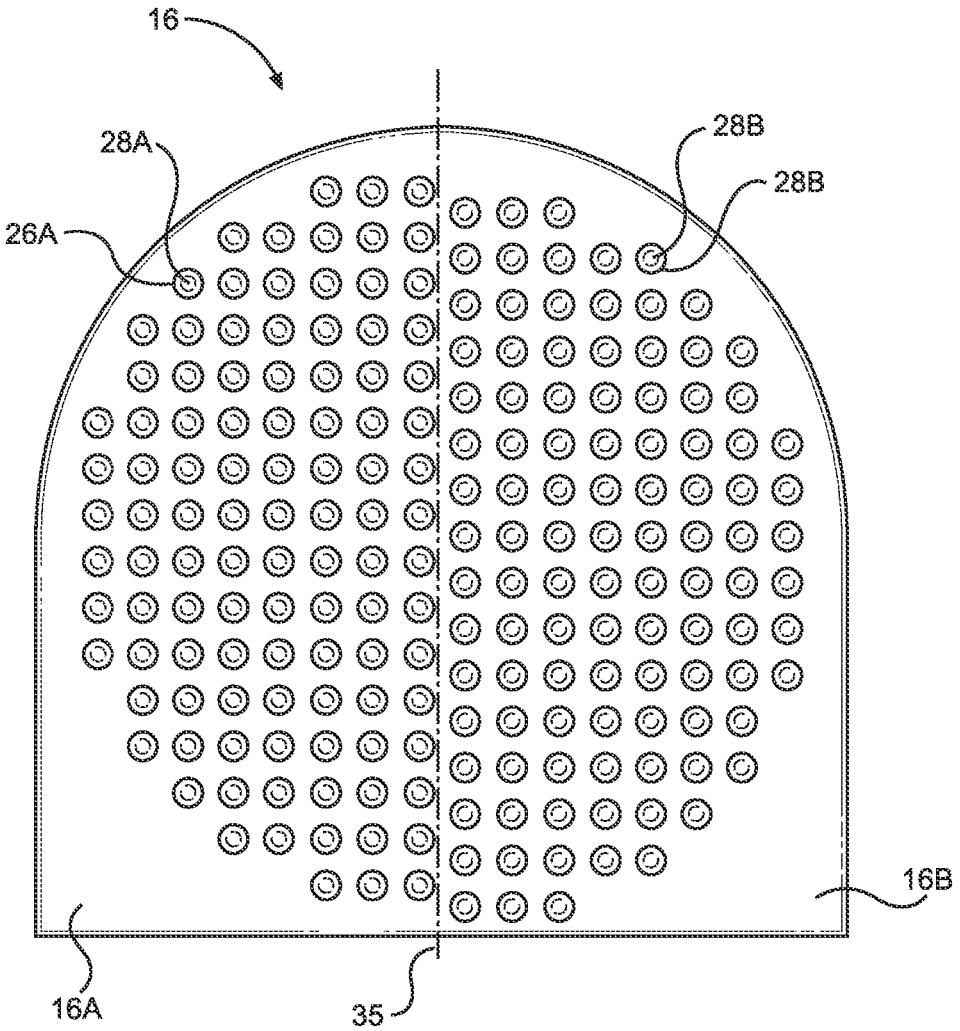
Figure 16:
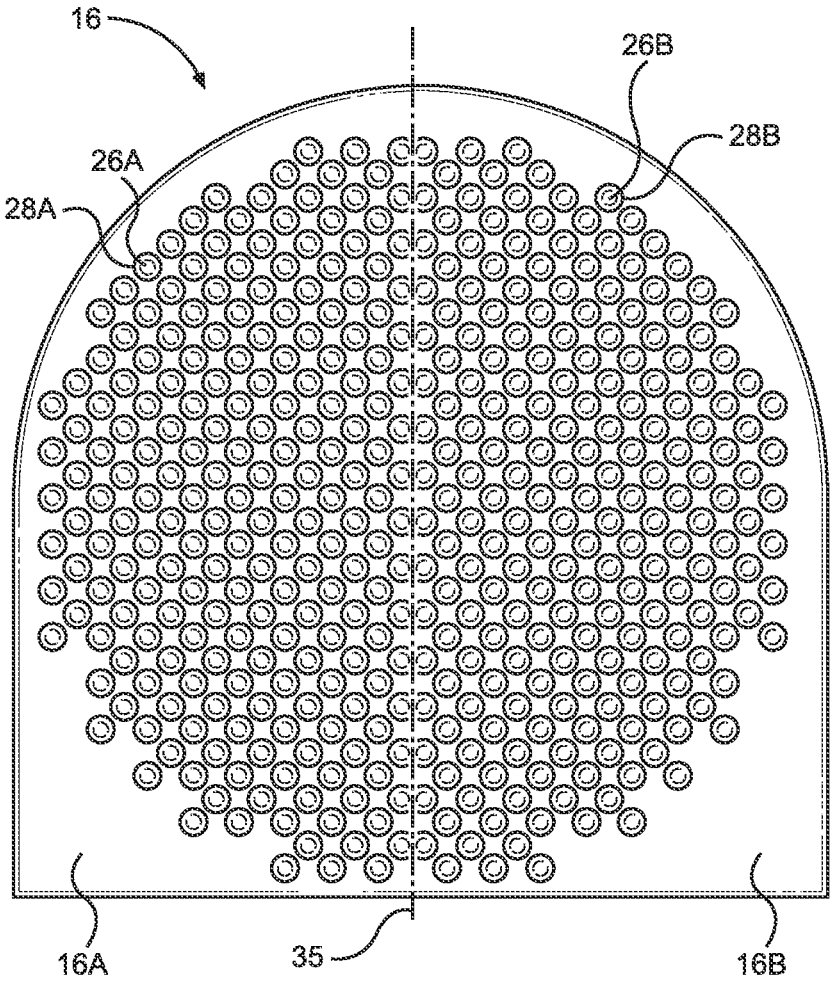
Figure 18:
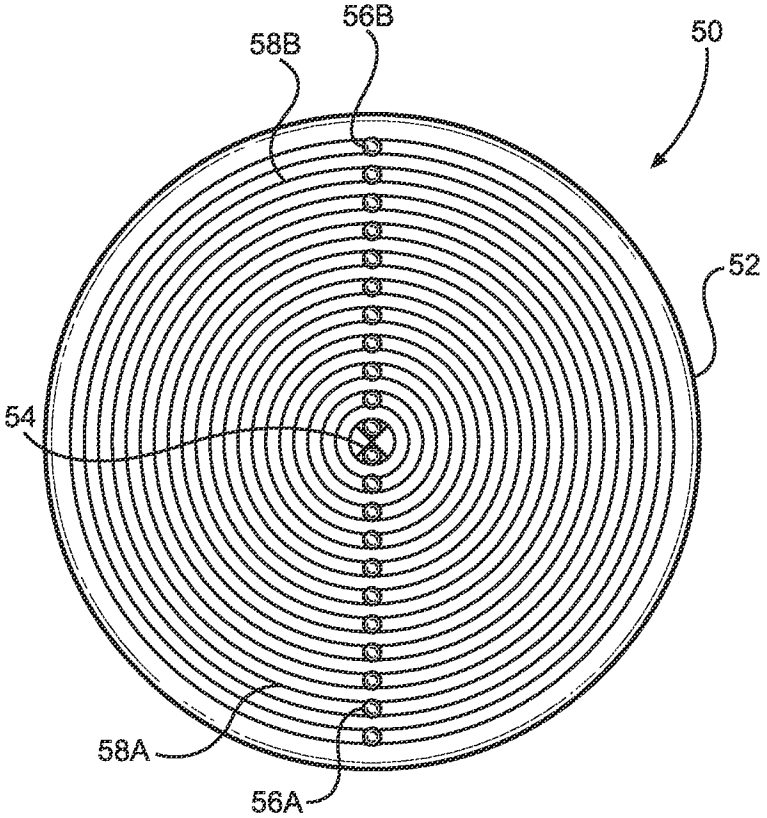
Figure 17:
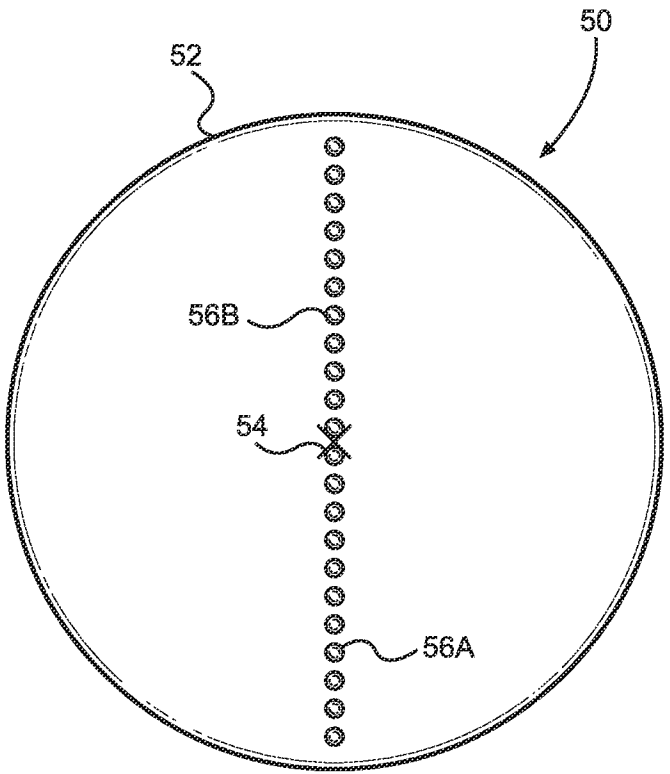
Figure 19:
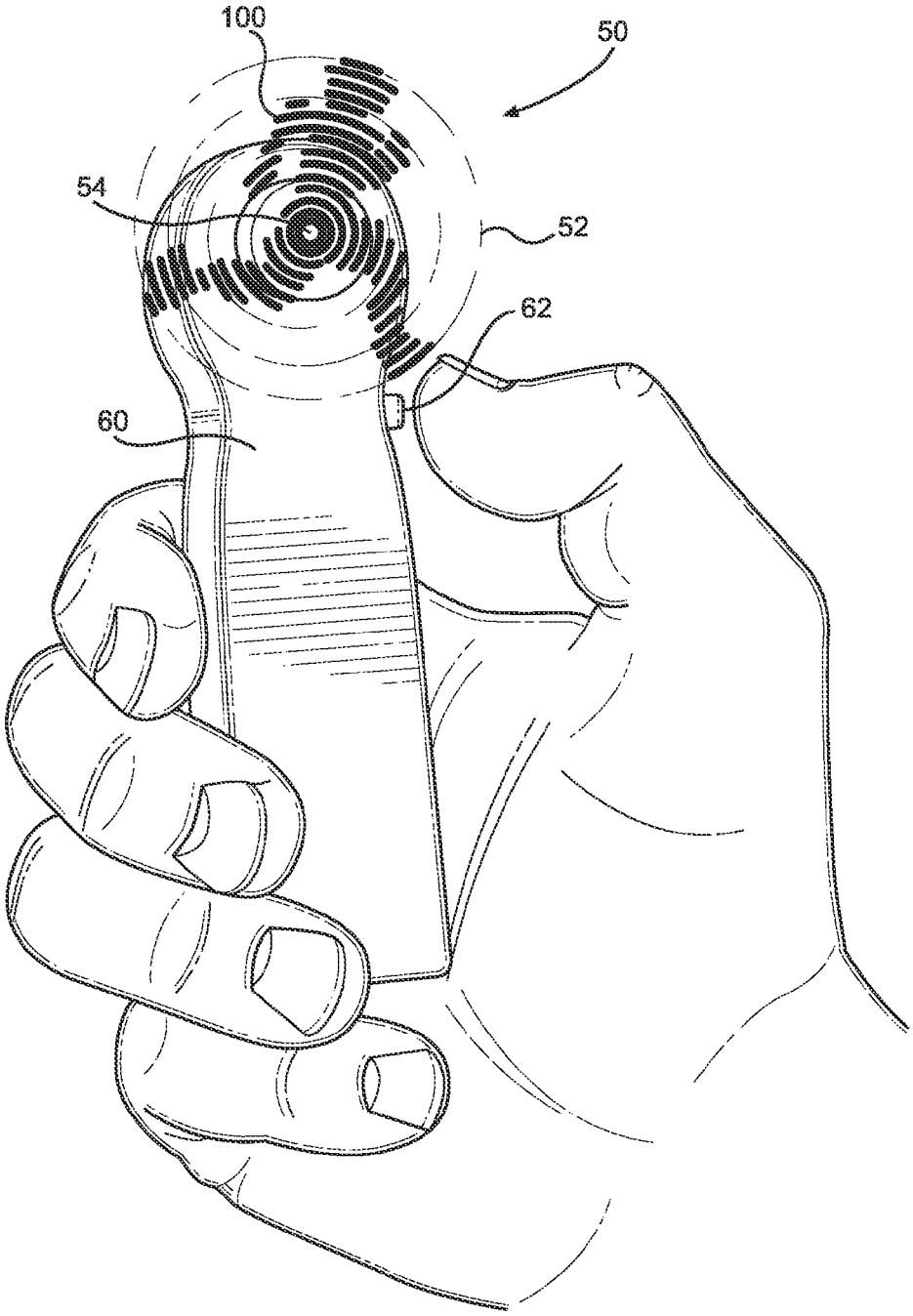
Figure 21:
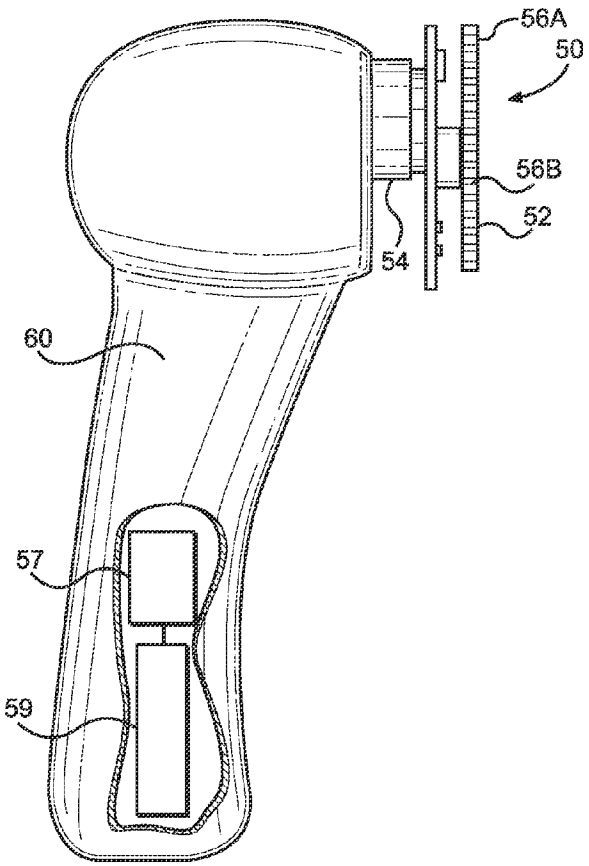
Figure 20:
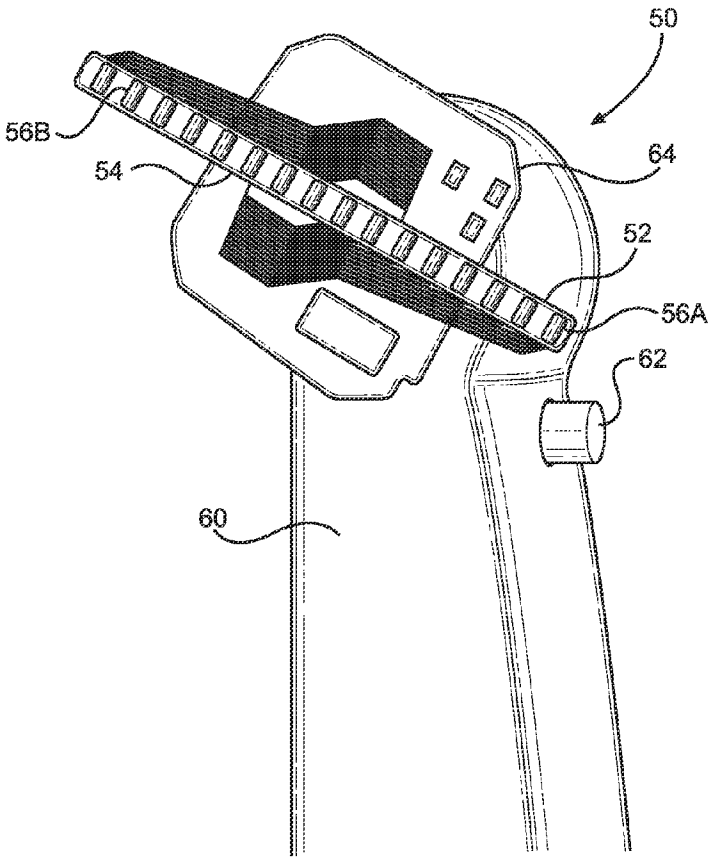
Figure 22:
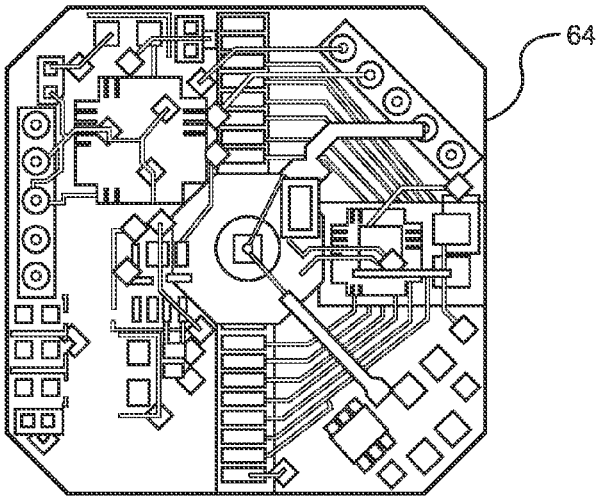
Figure 23:
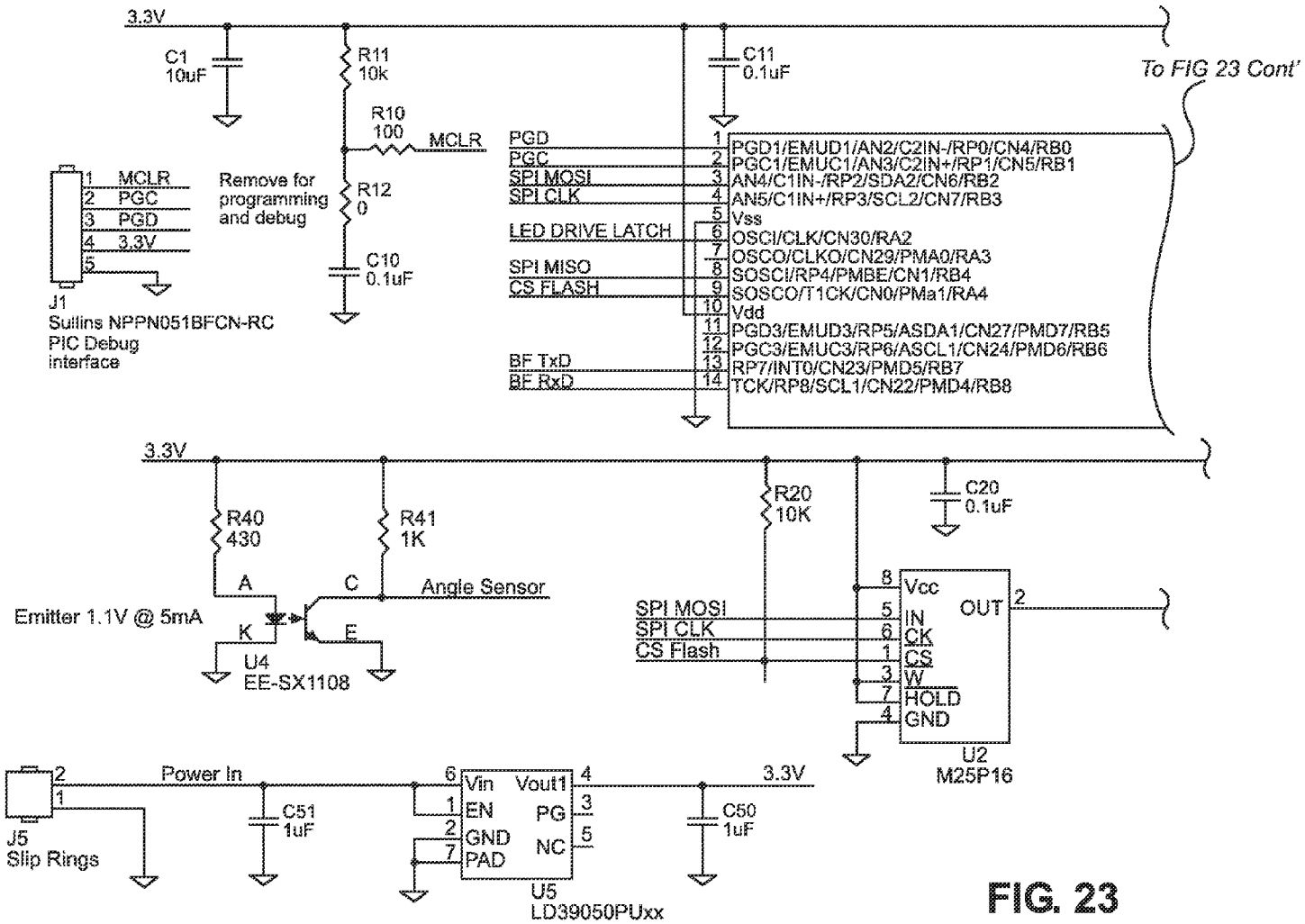
Figure 23:
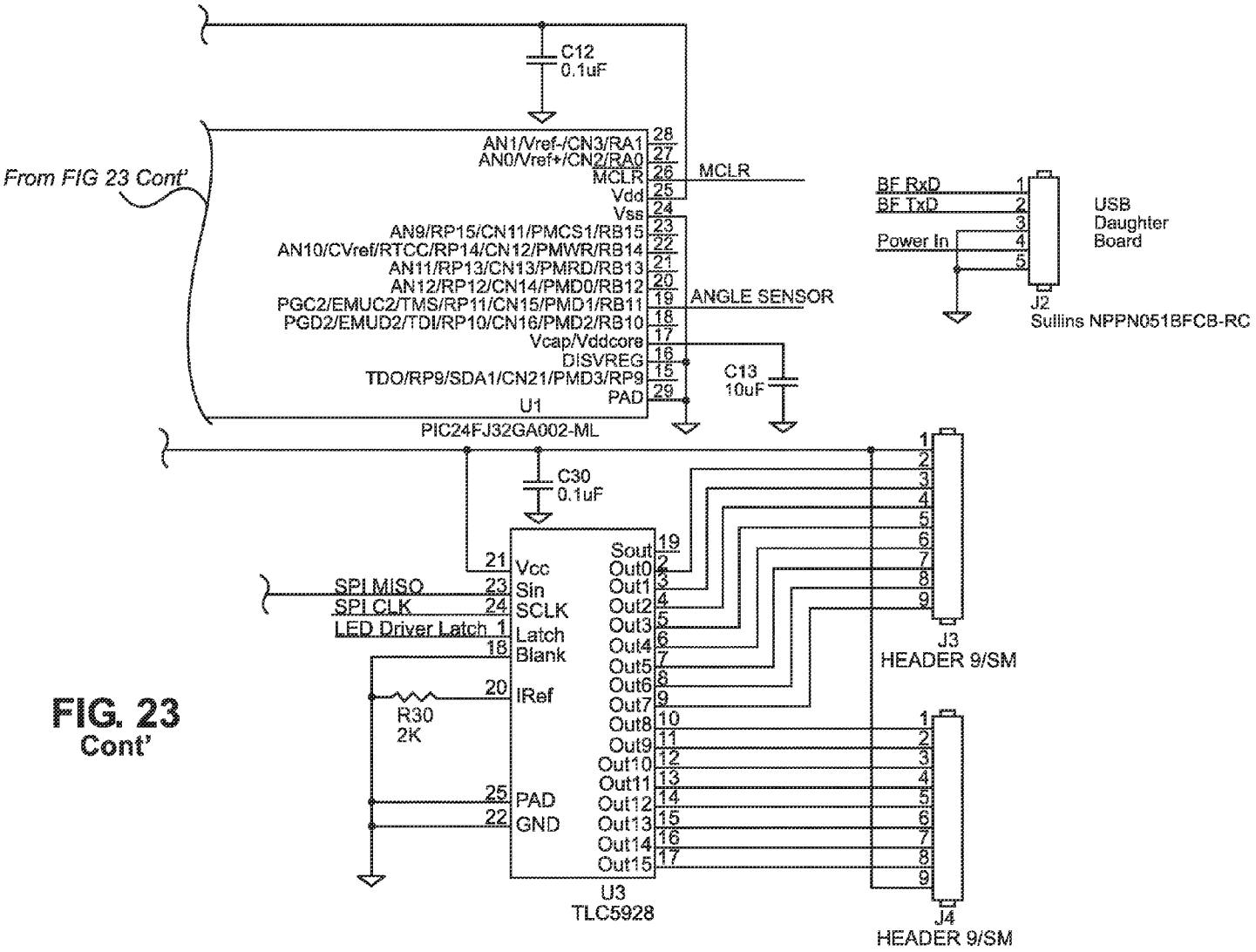
Figure 26:
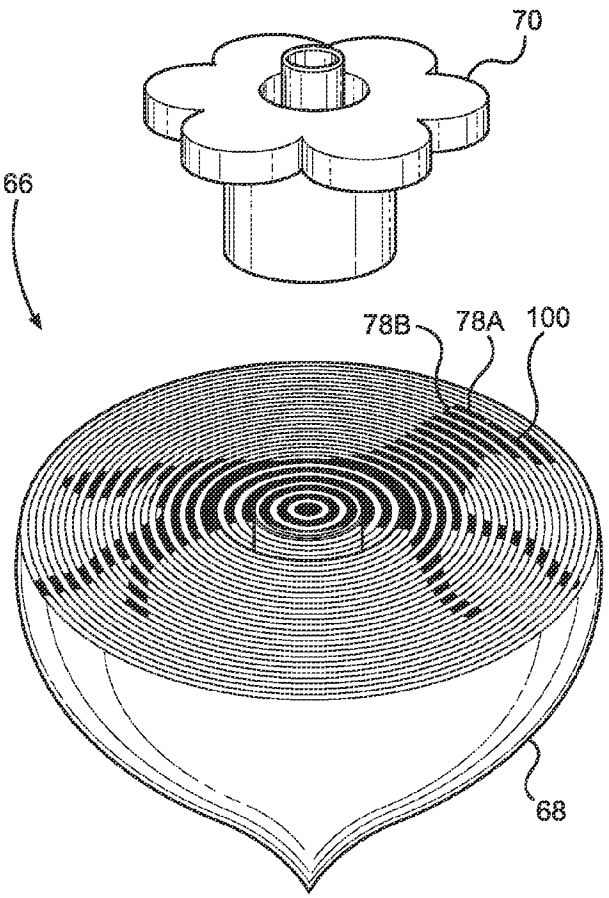
Figure 25:
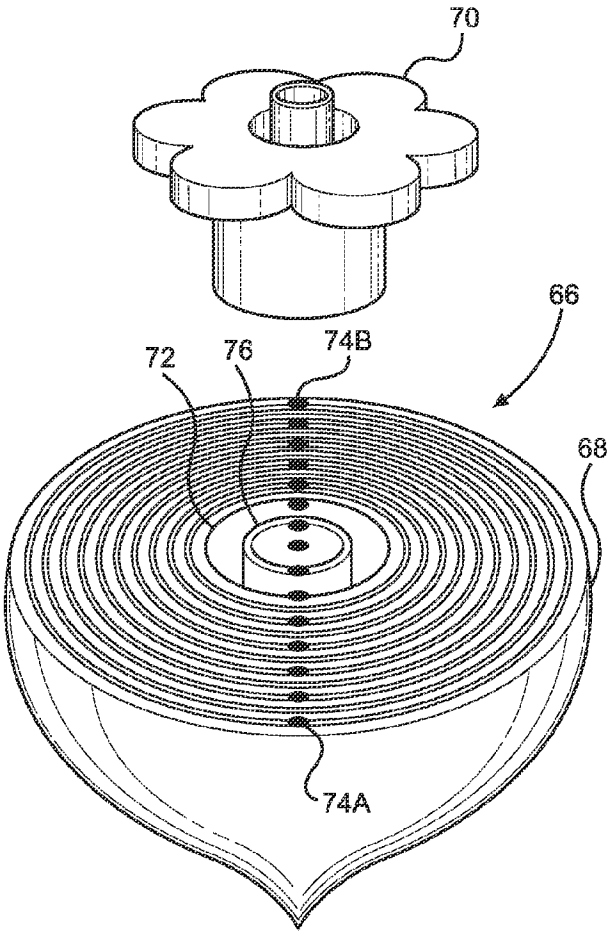
Figure 28:
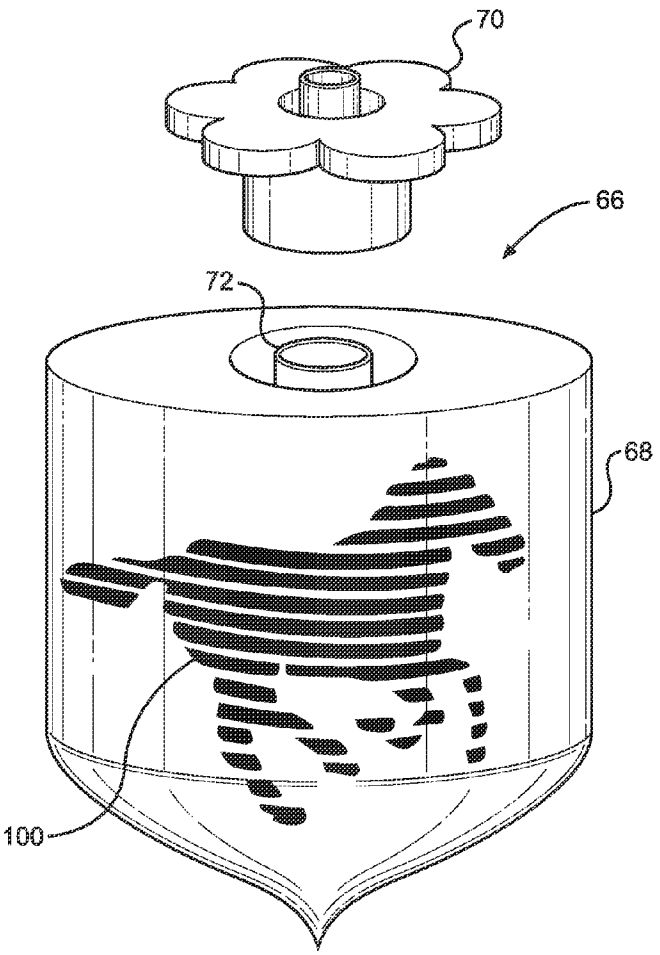
Figure 27:
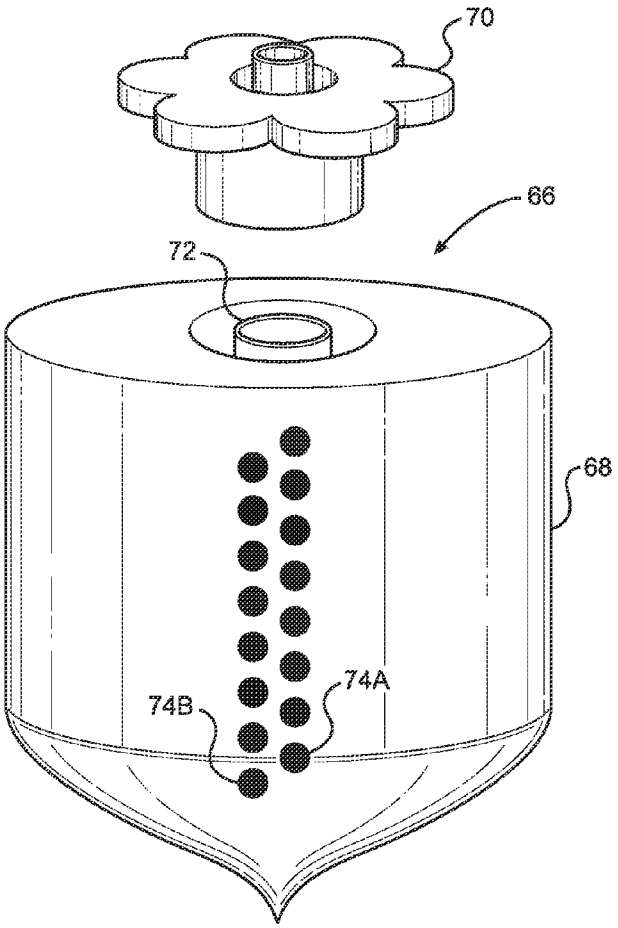
Figure 29:
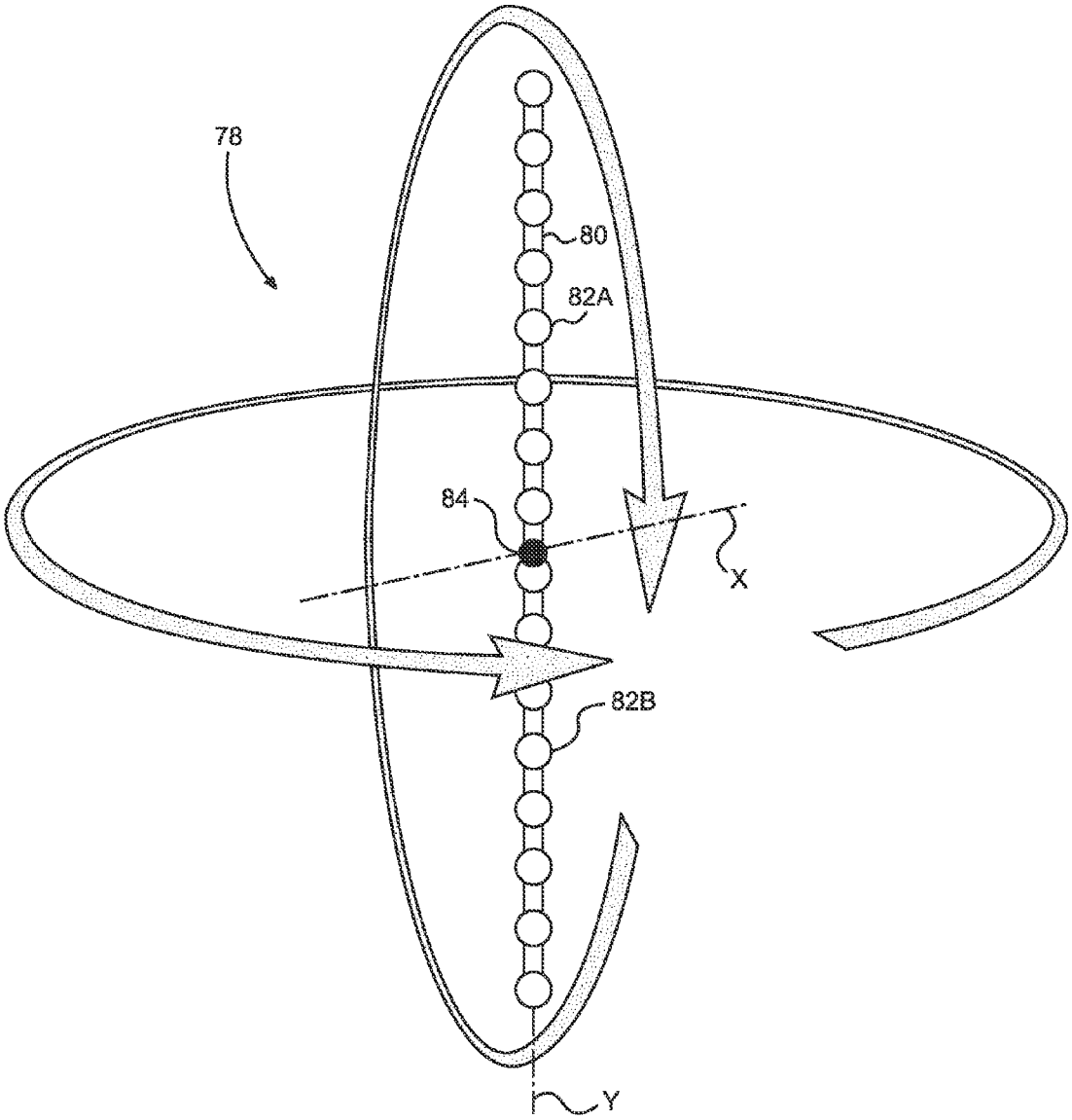
Figure 30:
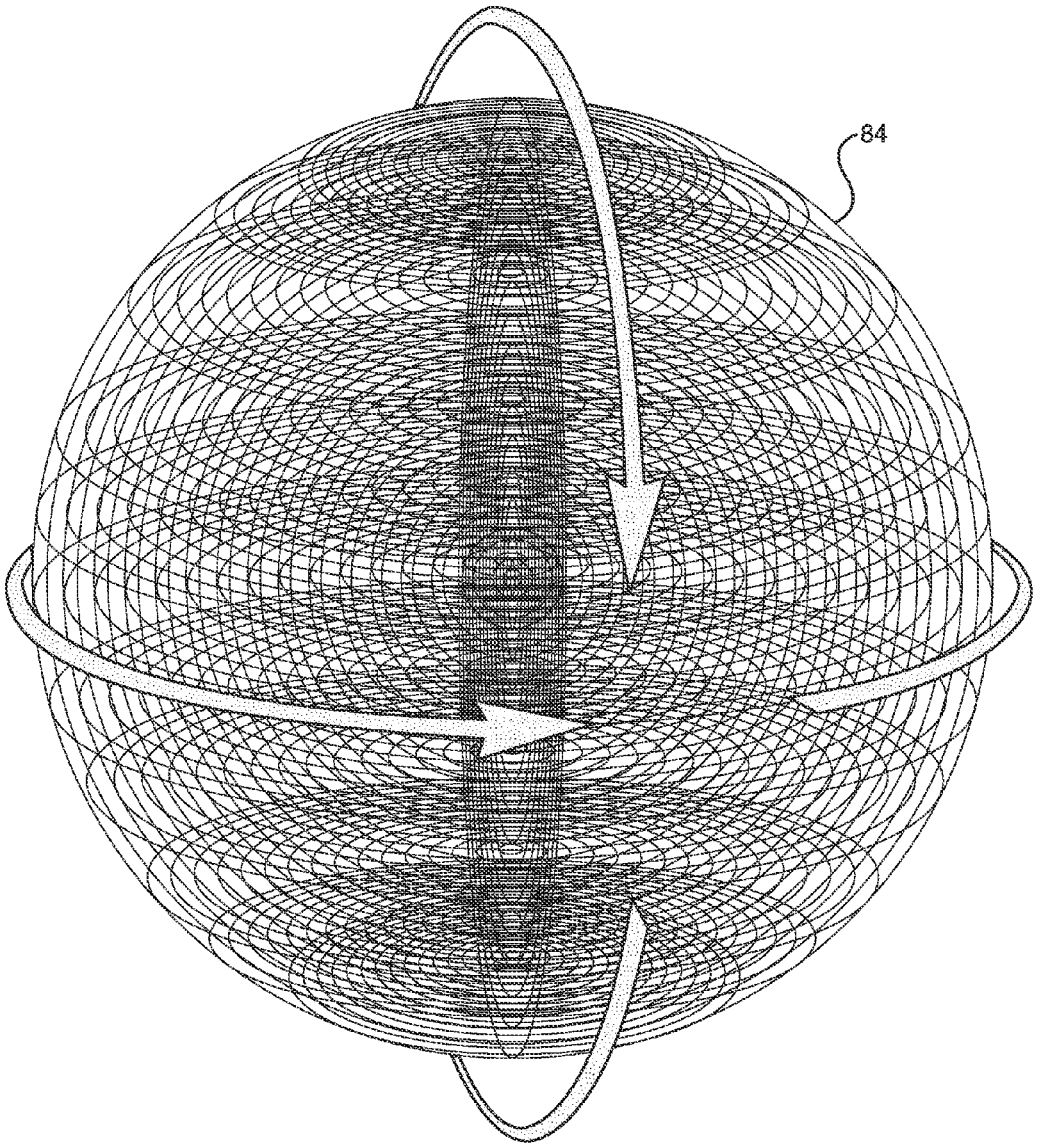

FIG. 6 is a perspective view of the head portion of the illuminated three-dimensional animation device of FIG. 1 again depicting the rotational support of the animation panel but with the animation panel in a second orientation;

FIG. 7 is a perspective view of the head portion of the illuminated three dimensional animation device with the motor and animation panel partially removed from the head portion;

FIG. 8 is an electrical power schematic for use under the present invention;

FIG. 9 is a schematic of the electrical connections driving the animation panel according to an embodiment of the invention;

FIG. 10 is a schematic of the electrical connections of a first portion of the animation panel;

FIG. 11 is a schematic of the electrical connections of a second portion of the animation panel;

FIGS. 12A through 12D depict volumetric animation images of a running boy;

FIGS. 13A through 13C depict volumetric animation images of a galloping horse;

FIGS. 14A through 14C depict volumetric animation images of a hummingbird;

FIG. 15 is a view in front elevation of an animation panel with staggered light sources as disclosed herein;

FIG. 16 is a view in front elevation of the animation panel of FIG. 15 depicting the illumination fields produced by the light sources during rotation of the panel;

FIG. 17 is a top plan view of a two-dimensional animation device with staggered illumination sources;

FIG. 18 is a top plan view of the two-dimensional animation device of FIG. 17 depicting the illumination paths followed by the staggered light sources;

FIG. 19 is a view in front elevation of a handheld two-dimensional animation device as taught herein in operation;

FIG. 20 is a perspective view of the handheld animation device of FIG. 19;

FIG. 21 is a view in side elevation of the handheld animation device of FIG. 19;

FIG. 22 is a top plan view of a circuit board for use in the handheld animation device of FIG. 19;

FIG. 23 is an electrical schematic for the handheld animation device of FIG. 19;

FIG. 24 is a chart of the mapping bits for a handheld animation device according to the invention;

FIG. 25 is a perspective view of a manually rotated animation device with staggered light sources as disclosed herein;

FIG. 26 is a perspective view of the manually rotated animation device of FIG. 25 in operation;

FIG. 27 is a perspective view of an alternative manually rotated animation device with staggered light sources as disclosed herein;

FIG. 28 is a perspective view of the manually rotated animation device of FIG. 27 in operation;

FIG. 29 is a schematic view in front elevation of an alternative rotatable animation device pursuant to the invention; and FIG. 30 is a view in front elevation of the rotatable animation device of FIG. 29 in operation.

DETAILED DESCRIPTION OF PREFERRED EMBODIMENTS

The invention for illuminated two-dimensional and three-dimensional animation with staggered illumination sources disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures.

Turning more particularly to the drawings, an embodiment of an illuminated three-dimensional animation device embodying the present invention is depicted generally at 10 in FIGS. 1 through 6. There, the animation device 10 takes the form of a handheld structure with a cylindrical handle 12 and a broadened head 14. An animation panel 16 is rotatably retained relative to the head 14 by a spindle 30 that projects from a base platform 32 disposed within the head 14. During operation of the animation device 10, the animation panel 16 is rotated by operation of a motor 38, which is depicted in FIG. 7. The motor 38 is disposed in a housing 40, which is received into the head 14 of the animation device 10.

Figure 4:
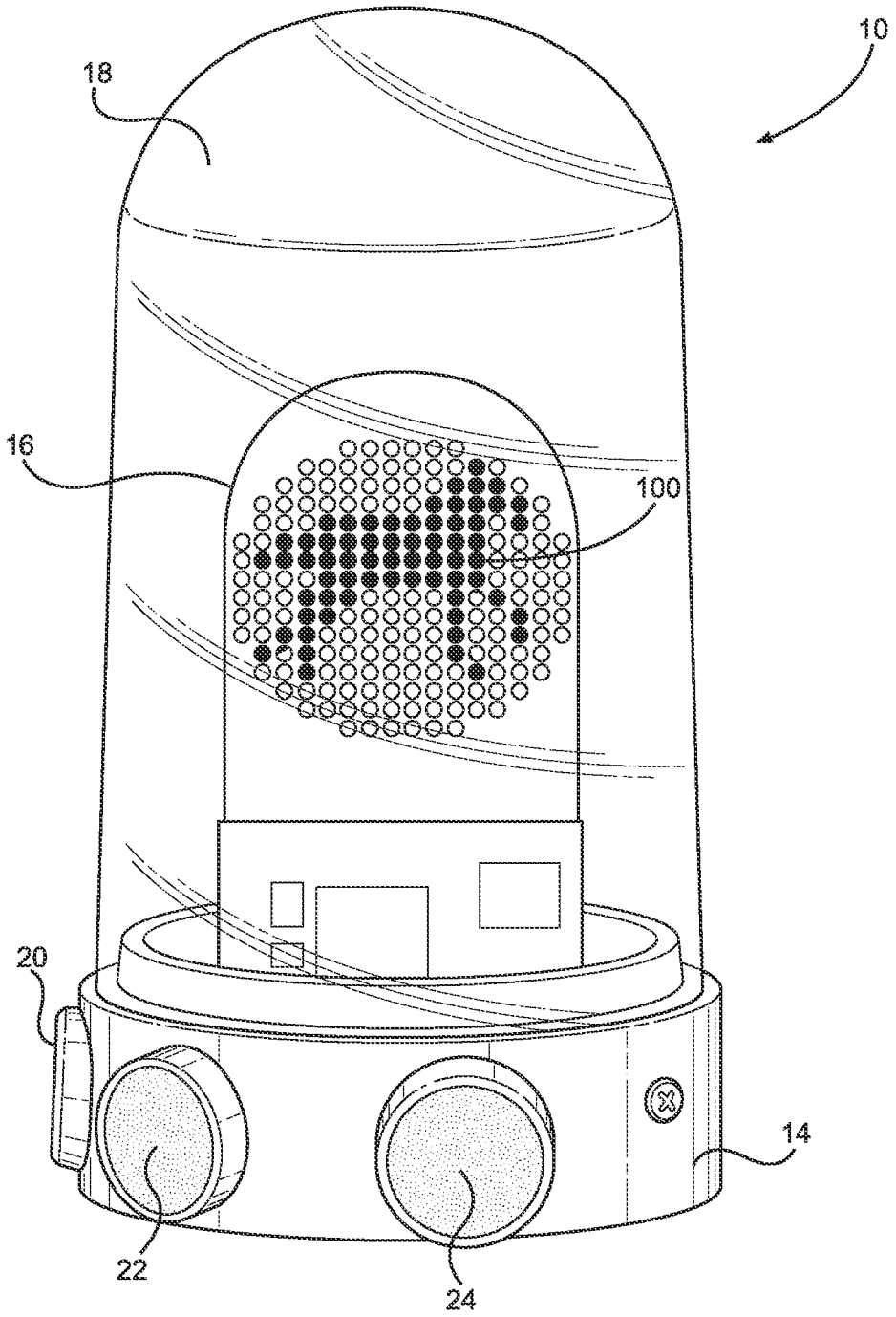
FIG. 4 is a perspective view of the head portion of the illuminated three-dimensional animation device of FIG. 1 during three-dimensional animation.

The animation panel 16 has a pattern of apertures 26 therein, and a light source 28 is disposed in each aperture 26. As described further hereinbelow, the light sources 28 can be selectively illuminated during rotation of the animation panel 16 to produce a three-dimensional volumetric animation 100 of selected subjects as is depicted in FIG. 4. A clear protective dome 18 houses the animation panel 16 and is engaged and retained by a peripheral portion of the head 14.

A user control interface is provided for permitting selective control of the rotation, illumination, and animation speed provided by the animation device 10 through rotation of the animation panel 16 and selective illumination of the light sources 28. In the depicted embodiment, the user control interface is presented in the form of first, second, and third buttons 20, 22, and 24 disposed in a retaining collar 15 that forms a distal portion of the head 14. It will be readily appreciated by one knowledgeable in the art that numerous other control interfaces could be provided within the scope of the invention except as it might be expressly limited.

In the present embodiment, actuation of either the second or third button 22 or 24 can send illumination and rotational power to the animation panel 16 from a power source, such as batteries (shown in FIG. 8 schematically) disposed in the handle 12 of the animation device 10. Actuation of the first button 20 can turn the power off to the animation device 10 by terminating the flow of current from the power source to the light sources 28 and the motor 38.

As disclosed herein, the second button 22 can also change the speed of the animation sequence, such as between a first speed, a second speed, and a third speed. By a repeated pressing of second button 22, the three animation speeds can be achieved in sequence. With that, for example, the animation device 10 can be adjusted from providing a three-dimensional animation of a person running at a first speed, a second speed, and a third speed by selective actuation of the second button 22. Of course, other means for adjusting the speed of the animation sequence are possible.

The third button 24, or any other suitable actuation means, can be employed to switch between animation images, which can be infinitely varied pursuant to the invention. By way of example, actuation of the third button 24 or other actuation means can convert the animated image from a running person, to a galloping horse, to a hovering hummingbird, and to any other organic or inorganic image retained in memory by the animation device 10. The second and third buttons 22 and 24 can be can be programmed to cycle repetitively, such as through the several speeds and multiple animation images. Of course, it would alternatively be possible to provide means for automatically selecting desired speeds and images.

Figure 2:
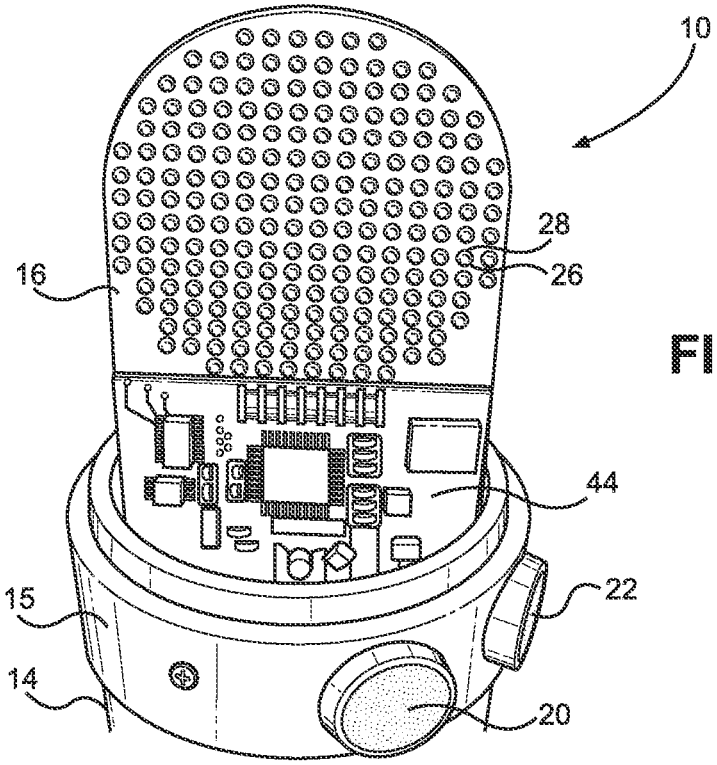
FIG. 2 is a perspective view of the head portion of the illuminated three-dimensional animation device of FIG. 1 with the animation panel in a first orientation and with the dome removed.
Figure 3:
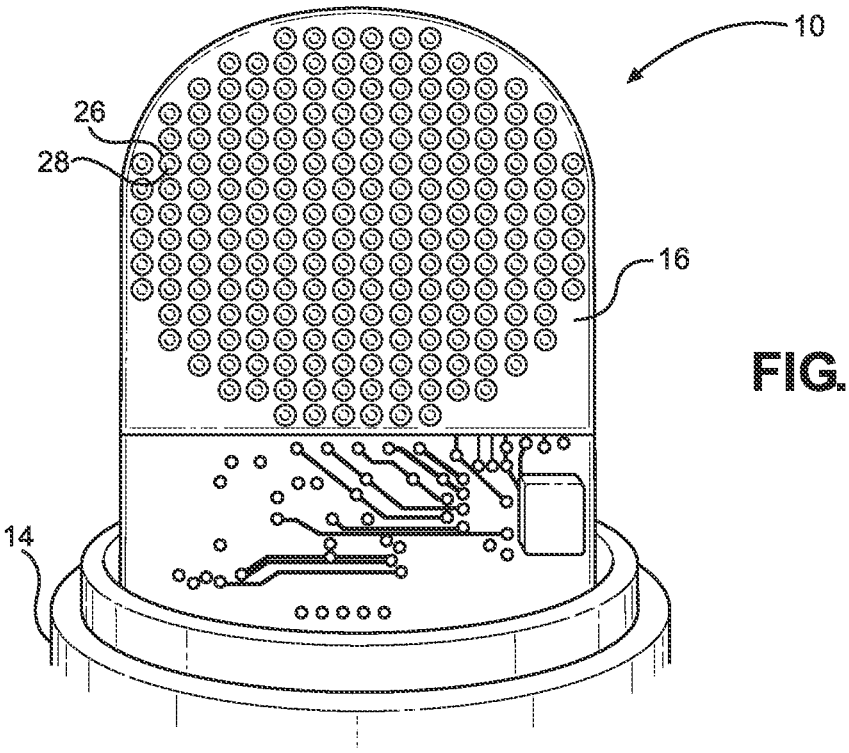
FIG. 3 is a perspective view of the head portion of the illuminated three-dimensional animation device of FIG. 1 with the animation panel in a second orientation, again with the dome removed.
Figure 5:
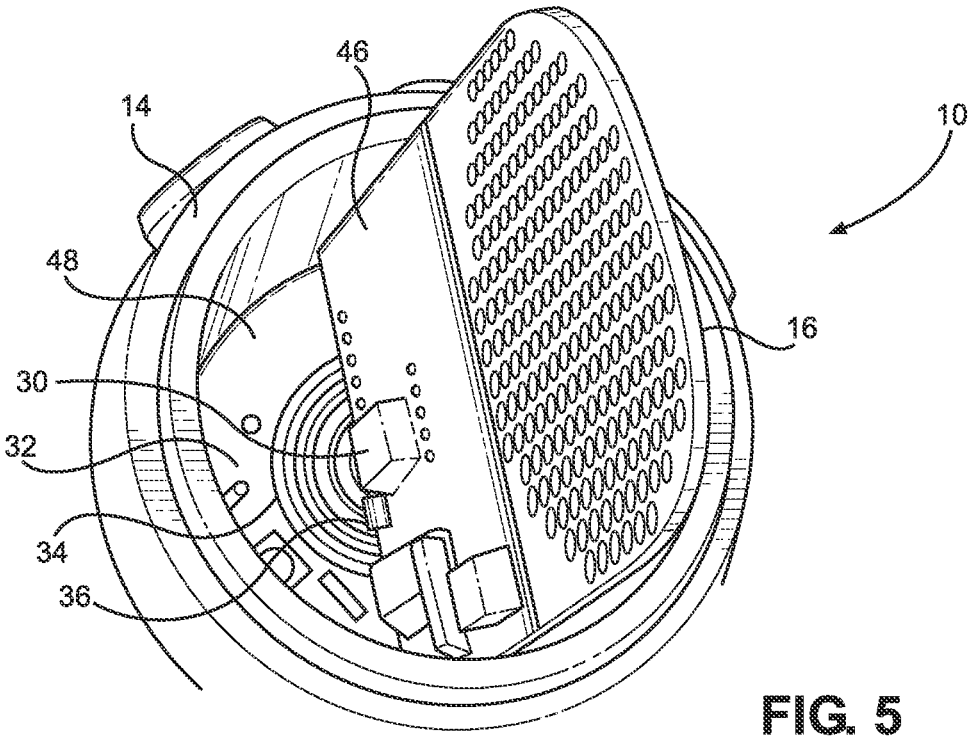
FIG. 5 is a perspective view of the head portion of the illuminated three-dimensional animation device of FIG. 1 depicting the rotational support of the animation panel with the animation panel in a first orientation.

In the depicted embodiment, the animation device 10 incorporates two circuit boards: a power board 46 as shown, for example, in FIG. 5 incorporated into the head 14 and a display board 44 as seen in FIG. 2 incorporated into the base portion of the animation panel 16. An electrical schematic for the power board 46 is depicted in FIG. 8, and an electrical schematic for the display board 44 is depicted in FIG. 9. Under this configuration, the power board 46 electrically connects the power source, such as a battery as in FIG. 8, the motor 38, and the first, second, and third buttons 20, 22, and 24. A flat flex cable 42 connects the motor 38 to the handle 12 and the power source retained therein. The spindle 30 projects through the power board 46.

With reference to FIGS. 5 through 7, four annular, electrically conductive slip ring contacts 34 are disposed atop the power board 46 concentrically with the spindle 30, and four rotary electrical interfaces are established between the slip ring contacts 34 on the power board 46 and four electrically conductive spring contacts 36 that extend from the proximal end of the animation panel 16 to ride along the slip ring contacts 34. Through the rotary electrical interfaces, the power board 46 transmits power and control signals to the display board 44, including during rotation of the animation panel 16. The display board 44 additionally incorporates a data connector 45, such as a USB connector, for permitting a loading of data files into memory and a programming connector 47, such as a five pin connector, to permit a programming of a microcontroller incorporated into the display board 44.

The power board 46 includes a voltage regulator that can be employed to adjust voltage supplied by the power source. For example, the voltage regulator can boost battery voltage up to 3.6V. That 3.6V voltage supply can be regulated as necessary at the power board 46 to operate as a power supply for the motor 38. The adjusted voltage is then sent to the animation panel 16 where it can be again adjusted, such as down to 3.3V, and that voltage can operate the several circuits disposed on the display board 44.

In addition to a microcontroller, the display board 44 incorporates one or more memory modules 51, in one embodiment comprising a one megabyte flash memory, drive circuits for the light sources 28, and a USB interface. A photo interrupter on the display board 44 aligns the animation with a pin on the power module. The display board 44 is attached directly to the spindle 30, which is the output shaft of the electric motor 38. The spindle 30 can operate at approximately 1200 RPM or 20 revolutions per second.

The apertures 26 and the light sources 28 are disposed in an approximately circular or disk-shaped array on the animation panel 16, and the electrical configuration of the array can be as shown schematically in FIGS. 10 and 11. As depicted, the array can be considered to comprise a sixteen by sixteen array of light sources 28 with the corners removed to approximate a circle. Here, there are six parallel longitudinal rows of sixteen light emitting diode (LED) light sources 28 and six parallel lateral rows of sixteen LEDs 28, each with two outboard rows of fourteen LEDs 28, one row of twelve LEDs 28, one row of ten LEDs 28, and one row of the six LEDs 28 that form the end of the orthogonal six rows of LEDs 28. Accordingly, there are 208 LEDs in the array.

The LEDs 28 are miniature, and the apertures 26 and the LED light sources 28 are disposed on 0.12" centers. The LEDs 28 are mounted inside 0.08" diameter apertures 26 that pass entirely through the animation panel 16. With that, the LEDs 28 are visible from both sides of the animation panel 16 even where, as in the present embodiment, the animation panel 16 is opaque or is rendered opaque. The animation device 10 can thus rotate the animation panel 16 while selectively illuminating the light sources 28 to produce volumetric, non-cyclic animations 100 from data retained in memory.

As taught herein, the animation panel 16 can be formed from a rigid material and can have or be caused to have a dark, preferably black, surface. The surface can have a matte finish or be otherwise finished or formed to minimize reflected light. In one embodiment, a black vinyl mask with apertures therein corresponding in shape, sized, and location to the apertures 26 in the animation panel 16 can be applied over each face of the animation panel 16. The dark surface provides higher contrast of the light sources 28 in relation to the animation panel 16, which is believed to provide clearer and more distinct images. In this aspect, an objective of the invention is to give the appearance of glowing points of light suspended in space with the animation panel 16 effectively disappearing.

Under the control of the display board 44 and the power board 46 in combination with angular position, velocity, and, additionally or alternatively, acceleration sensors, the animation device 10 can modify the animation 100 produced by the light sources 28 to achieve, for example, added realism and an improved display effect. It is additionally contemplated to modify the perceived brightness of regions of the volumetric 3-D image. Brightness can be adjusted depending on the location of the respective light sources 28 within the volume of the animation 100 to produce an animation image 100 that is optimized, such as to have an apparently consistent brightness despite a denser cluster of illuminated light sources 28. By way of example, the present inventors have appreciated that, since a light source 28 at the outer edge of the array travels farther than light sources 28 on the inside, the outer light source 28 may appear dimmer than the inner light sources 28, which remain in a more constant location. To compensate for this effect, the current sent to the array can be varied as a function of the distance of the respective light source 28 from the axis of rotation of the array. To accomplish this, the drivers for the light sources 28 can display one column at a time, and the current can be varied at the driver to a value corresponding to its position.

Accordingly, the adjustment in brightness can be achieved in a number of ways and through a number of means within the scope of the invention. Under one practice of the invention, the duty cycle of energizing specific light sources 28 may be adjusted. Alternatively or additionally, the current to specific light sources 28 may be manipulated to produce desired variations in brightness. Moreover, pursuant to the invention, consistent brightness across all or several light sources 28 can be achieved through similar or varied methods. It is even further contemplated that an accelerometer can be incorporated into the animation device 10 to sense an angular disposition and movement of the device 10 and, potentially, to adjust the animation image 100 in response thereto.

It would be within the scope of the invention to achieve brightness variation through software during render-time (i.e., the Artwork-to-Bitmap phase) that would zero-out some percentage of the "on" light sources 28 as a function of radius. Brightness modulation can be effected by pulse-width modulation (PWM) of the light source drive signals. Performed in the time-domain, the motion of the light sources 28 converts the modulation to the space domain. Since the smaller radii, namely the light sources 28 nearest the center, sweep out correspondingly short circumferences, the spatial PWM might be perceived as an attenuation of the brightness. PWM can be encoded into the data set that the Artwork-to-Bitmaps Software creates, or it can be performed in the microcode for the animation device 10. Still further, it is contemplated to run the flash at a higher rate and flicker the LED of the inner circles. A portion of current can be shunted for the brightest pixels to bring them into a desired brightness range. Still further, one may be able to interpose a line of AND gates between light source signals and the light sources 28. If the "A" input is driven by the digital light source lines, the "B" inputs could be driven by slightly different PWM signals of duty cycles that reach 100% for the outermost LED.

In the present embodiment, the drivers for the light sources 28 receive a serial data stream of 16 bits for each column of the array or slice of an image. Each slice contains 256 bits or 32 bytes of data. It will be recognized, however, that some of the bits are not displayed. Instead, they are used merely to align the displayed bits properly in the driver for the light sources 28. As noted previously, the memory module can comprise a one megabyte flash memory. The flash memory can have sixteen sectors of 64 kB each. Each of the sixteen sectors can hold either an animation or a still image, and memory can be selectively erased by the sector.

Accordingly, the data required for producing volumetric, three-dimensional animations 100 as taught herein comes in slices, volumes, and animations. Each slice is 32 bytes, including 6 bytes of padding, each volume is 64 slices or 2048 bytes, and each animation can be up to 24 volumes or 49152 bytes. Data files transferred to the animation device 10 can have a header that sets for the file size and a specified destination in the flash memory. The header can include other necessary file information, such as whether a volume is repeated. The driver for the light sources 28 can place the first received serial bit in output 16 and the succeeding serial bits in descending outputs until the last is placed in output 1. The serial peripheral interface sends the most significant bit first and the least significant bit last.

In one presently contemplated embodiment, the file is an ASCII file. White space is ignored. Commas and other delimiters can also be ignored. The slice data should be sent as hexadecimal ASCII with two 8 bit values per display column. Columns can be numbered from left to right with each column having two bytes of data. The most significant bit of the first byte corresponds to the bottom row of the display. The least significant bit of the second byte corresponds to the top row of the display.

Pursuant to the invention, therefore, the two-dimensional animation panel 16 can be employed to produce three-dimensional, volumetric animations 100 of an infinite variety of organic and inorganic subjects. To accomplish this, software as described herein converts data stored in a 3-D rectangular voxel grid of one resolution into data formatted for a cylindrical voxel grid of a different resolution. The process of converting a set of 3D polygons to their equivalents in blocks is called voxelization. With the memory capabilities described herein, 512 volumes or frames can be retained in flash memory. At 10 frames per second, at least 51 seconds of animation can be produced with a one megabyte of flash memory.

Using a program, such as the command-line program Binvox, three-dimensional animation images 100 can be created as .binvox files as illustrated in FIGS. 12A through 14C. More particularly, as suggested by FIGS. 12A through 12D, a running boy animation image 100 can be created pursuant to the invention. The animation device 10 can also display a galloping horse animation image 100 as in FIGS. 13A through 13C, a hovering hummingbird animation image 100 as in FIGS. 14A through 14C. In each case, the data can begin as a 64×64×64 group of cubes as in FIGS. 12A, 13A, and 14A and is processed for each image frame to display on the 16×16 array of light sources 28 as shown in FIGS. 12B through 12D, 13B, 13C, 14B and 14C. With this, the animation device 10 achieves volumetric three-dimensional display in a handheld embodiment using pre-programmed three-dimensional animations 100 with variable playback speeds. Depending on the goals of the manufacturer and user, the animation device 10 can be used in substantive applications, as a toy, or some combination or variation thereof.

In one practice of the invention, the rendering procedure can be summarized as follows:

1. Connect USB or other data cable and load a computational software program notebook, such as the program referred to by the registered trademark MATHEMATICA by Wolfram Research, Inc. of Champaign, Ill.; comment out any "executable" commands; Evaluate notebook
2. Move .obj files to the same directory as binvox
3. (Using COMMAND PROMPT) CD to the directory containing binvox and the .obj files.
4. C:>binvox -d 64 -bb -1000 -1000 -1000 1000 1000 1000 -rotx -rotx Cat1.obj (figure out the number of "-rotx" commands by trial and error; it depends on how the OBJ was created)
   a. Special notes:
   b. Bear: binvox -d 64 -cb -rotx -rotx Bear8.obj
   c. Hummingbird 3 used: binvox -d 64 -cb -rotx -rotx Bird1.obj
   d. Regarding recentering the running boy. binvox's voxel view utility to preview the centration for a variety of bounding box coordinates. (Hit "r" and "y" in vox view.)
      i. binvox -d 64 -bb -1850 -1642 -1000 1126 1407 1449 -rotx -rotx BoyN.obj (this was still too small)
      ii. binvox -d 64 -bb -1480 -1314 -800 901 1126 1159 -rotx -rotx Boy3.obj
      iii. binvox -d 64 -bb -1560 -1314 -1200 820 1126 759 -rotx -rotx Boy6.obj
5. Repeat for all .OBJ files
6. Move the resulting .binvox files to the directory that the computational software program executes from
7. In "process gallop animation and write to disk," process just one frame to test for orientation like this
   frame1=render["Horse1.binvox","Horse_0_1.txt"]
8. After computational software program renders it, it will show a drawing of the data. The drawing should make the desired image "upside down." If it is rotated otherwise, it will be wrong. Try using more or fewer -rotx commands.
9. Move the resulting *.txt and *.binvox files to a holding-folder. If one is processing an animation, put them all together, with something like this at the header (as defined in DataFormatRev2.doc):
   ta
   f2
   v 12
   [paste txtfile 1 here]
   [paste txtfile 2 here] . . . and so on.
10. Save it with ANIM in the filename, ending with .txt
11. Upload it to the 3D display:
12. Connect the computer and the display:
    a. Display off. Motor switch OFF. Disconnect USB cable.
    b. Connect USB cable to display
    c. Turn on display
    d. Connect USB cable to computer
    e. Start Hyperterminal Private Edition 6.3
    f. Load ETI toy proto profile
    g. Flip a switch, like ANIMATION/STILL, to confirm connection
13. Perform transfer
    a. Move knobs to the location you want to load to
    b. D (for download)

c. y (downloading animation?)
d. y (erase sector?)
e. TRANSFER>TEXT FILE
f. While it's downloading (uploading, really) DON'T SWITCH TO ANY OTHER APPLICATIONS otherwise HyperTerminal will crash
g. "hang up"
h. Switch display off
i. Disconnect USB cable As the several frames of animation are rendered through the light sources 28, the animation image 100 can, where desired, be maintained in a consistent orientation in relation to the animation device 10, such as by synchronizing animation in relation to a timing post. Conversely, the animation image 100 can be caused to rotate progressively by incrementing a slice value associated with the timing post or mark. More particularly, in one example, in the interrupt routine associated with the timing mark, the value of the slice associated with the timing mark can be incremented on every third rotation. The incremented value can then become the current slice. The slices can be incremented on a timer for the rest of the rotation.

It will again be appreciated that improved resolution of images 100 displayed by the animation device 10 is a basic goal of embodiments of the invention. In that regard, one will note that the animation panel 16 in the embodiment of FIGS. 1 through 6 is entirely symmetrical. The animation panel 16 has an axis of rotation longitudinally centered with the panel 16, and apertures 26 and the retained light sources 28 to the first side of the axis of rotation correspond in longitudinal and lateral coordinates to corresponding apertures 26 and light sources 28 to the second side of the axis of rotation. Accordingly, when the animation panel 16 is rotated and corresponding light sources 28 to opposite sides of the axis of rotation are illuminated, the light sources 28 will follow substantially identical paths. With that, the path of illumination provided by a light source 28 to the first side of the axis of rotation will overlap and be redundant with the path of illumination provided by a light source 28 to the second side of the axis of rotation. Despite having two light sources 28, there is just one path of illumination.

Appreciating this, the present inventors realized that it would be advantageous if light sources 28 to opposing sides of an axis of rotation did not follow the same path of illumination. Where light sources 28 to opposing sides of the axis of rotation do not have overlapping paths of illumination, each will establish its own distinct path of illumination. With each light source 28 providing its own path of illumination, the resolution of resulting images 100 is automatically increased with each light source 28 imprinting a different, even if ephemeral, portion of the image 100 on the eyes of the viewer. To accomplish this, the present inventors have conceived of staggering the light sources 28 to opposite sides of the axis of rotation such that light sources 28 to the first side of the axis of rotation differ in longitudinal position, lateral position, or both longitudinal and lateral positions from light sources 28 to the second side of the axis of rotation.

A three-dimensional embodiment of the invention for providing rotatable animation devices 10 with staggered arrays of light sources 28A and 28B is depicted in FIGS. 15 and 16. There, the animation panel 16 is divided by the longitudinal axis of rotation 35 into a first panel half 16A and a second panel half 16B. The apertures 26A and light sources 28A retained by the first panel half 16A are staggered in relation to the apertures 26B and light sources 28B retained by the second panel half 16B such that the light sources 28A follow different paths of illumination from the light sources 28B. Again, the light sources 28A and 28B can comprise LEDs or any other suitable source of light that might now exist or hereafter be developed.

In this example, the number of light sources 28A retained in an array by the first panel half 16A equals the number of light sources 28B retained in an array by the second panel half 16B, but that need not be the case except as the invention may be expressly limited. As used herein, the terms stagger, staggered, or the like shall mean to have different longitudinal, lateral, or longitudinal and lateral positions from corresponding light sources 28A or 28B to opposite sides of the axis of rotation 35. In the example, depicted in FIG. 15, for example, the light sources 28A and 28B are substantially evenly spaced on each panel half 16A and 16B, and the light sources 28A retained by the first panel half 16A differ from the light sources 28B retained by the second panel half 16B in both lateral and longitudinal positions. More particularly, the light sources 28A and 28B are staggered in lateral and longitudinal positions by approximately the one-half the distance between light sources 28A and 28B retained relative to a given panel half 16A or 16B.

Consequently, the light sources 28A will establish different paths of illumination from the light paths established by the light sources 28B, and images 100 of greater resolution can be achieved than if the light sources 28A and 28B were in corresponding longitudinal and lateral positions. In FIG. 16, the points along the light paths established by the light sources 28A and 28B are shown, and it can be seen that the distinct light paths established by the light sources 28A and 28B are disposed in the interstitial spaces between one another thereby allowing each light source 28A and 28B to contribute its own annular ring or portion or portions of an annular ring of light. In earlier embodiments as in FIGS. 1 through 6, the 208 light sources 28 would ultimately produce only 104 distinct paths of illumination as illumination sources 28 would follow paths of illumination established by corresponding illumination sources 28. Here, however, the 208 light sources 28A and 28B produce 208 individual paths of illumination thereby enabling markedly increased the resolution in resulting images.

The invention for rotatable animation devices with staggered illumination sources also has application to two-dimensional animation devices. As seen in FIGS. 17 and 18, a two-dimensional animation device 50 has a rotatable member 52, which can comprise a disk, a bar, a fan with blades, or any other structure, whether unitary or in multiple pieces. The member 52 is rotatable, whether manually, by motor, or by any other force to have an axis of rotation 54. A plurality of light sources 56A are disposed to a first side of the axis of rotation 54, and a plurality of light sources 56B are disposed to a second side of the axis of rotation 54. The light sources 56A retained to the first side of the axis of rotation 54 are staggered in relation to the light sources 56B disposed to the second side of the axis of rotation 54 such that the light sources 56A follow different paths of illumination from the light sources 56B.

In this example, the number of light sources 56A retained to the first side of the axis of rotation 54 equals the number of the light sources 56B disposed to the second side of the axis of rotation 54. Again, that need not be the case except as the invention may be expressly limited. As used in relation to this two-dimensional animation device 50, the terms stagger, staggered, or the like shall mean to have different radii from corresponding light sources 56A or 56B to opposite sides of the axis of rotation 54. In the example depicted in FIGS. 17 and 18, for example, the light sources 56A and 56B are substantially evenly spaced and are staggered by a distance of approximately one-half of the distance between adjacent light sources 56A and 56B.

With the light sources 56A and 56B so disposed, the light sources 56A will establish different paths of illumination 58A from the paths of illumination 58B established by the light sources 56B as is best seen in FIG. 18. The paths of illumination 58A established by the light sources 56A are interposed between the paths of illumination 58B established by the light sources 56B. As a result, images 100 of greater resolution can be achieved than if the corresponding light sources 56A and 56B had matching radii. The distinct light paths 58A and 58B established by the light sources 56A and 56B allow each light source 56A and 56B to contribute its own annular ring or portion or portions of an annular ring of light.

A two-dimensional animation device in handheld form exploiting staggered light sources is indicated generally at 50 in FIGS. 19 through 21. There, the animation device 50 has a rotatable member 52 comprising a blade that is rotatable about an axis of rotation 54 under power provided by a motor 57 and a power source 59. A plurality of light sources 56A are disposed to a first side of the axis of rotation 54, and a plurality of light sources 56B are disposed to a second side of the axis of rotation 54. The light sources 56A retained to the first side of the axis of rotation 54 are staggered in relation to the light sources 56B disposed to the second side of the axis of rotation 54, namely by having different radii, such that the light sources 56A follow different paths of illumination from the light sources 56B.

The rotatable member 52 has a circuit board 64, which is shown apart in FIG. 22, that is rotatable therewith in relation to a body portion 60 through the axis of rotation 54 in the form of a spindle. The circuit board 64 has a flex-circuit holding LEDs, and the animation device 50 includes electronics with a microprocessor to execute program software. An actuator, in this case a button 62, allows the animation device 50 to be selectively actuated and deactivated. An electrical schematic for the animation device 50 is shown in FIG. 23, and FIG. 24 provides a chart of mapping bits for illuminating the light sources 56A and 56B.

As is illustrated in FIG. 19, by exploitation of the staggering of the light sources 56A and 56B, animation images 100 can be created where each light source 56A and 56B forms distinct portions of the image 100. With that, despite the light sources 56A and 56B being disposed on opposed sides of the axis of rotation 54, a given radial portion of the image 100 can be simultaneously formed by illumination from the illumination paths of as many as all of the illumination sources 56A and 56B through persistence of vision. The radial portion of the image, such as the leg of the running man image 100 in FIG. 19 can have resolution including portions of the distinct light paths of all of the light sources 56A and 56B thereby improving the possible resolution compared to a device where the light sources to opposite or different sides of an axis of rotation share a common radii.

It will be understood that the invention for rotatable animation devices with staggered illumination sources has still further applications. By way of example, one may have reference to the alternative embodiments of FIGS. 25 through 28. In those figures, the rotatable animation device, which is indicated generally at 66, is manually rotatable and takes the form of a top, but any spinning device could be employed. The animation device 66 of FIGS. 25 and 26 has a rotatable body portion 68 with a tip for being spun to rotate as a top. The body portion 68 can be rotated in any effective way. In this example, a removable handle 70 is provided for selectively engaging a reception groove in the body portion 68. With that, the body portion 68 can be spun by use of the handle 70 to establish an axis of rotation 76, and the handle 70 can be removed to expose the upper display surface of the body portion 68.

A plurality of light sources 74A are disposed to a first side of the axis of rotation 76, and a plurality of light sources 74B are disposed to a second side of the axis of rotation. As in the embodiments of FIGS. 17 through 21, the light sources 74A and 74B are disposed in a straight line and are substantially evenly spaced. The light sources 74A and 74B are staggered with corresponding light sources 74A and 74B having different radii such that the paths of light established by the light sources 74A are interposed with the paths of light established by the light sources 74B to establish images 100 of enhanced resolution during rotation of the body portion 68 as illustrated in FIG. 26.

In the variation of FIGS. 27 and 28, light sources 74A and 74B are disposed in parallel lines to face outwardly on a cylindrical outer surface of the body portion 68. Although both lines of light sources 74A and 74B are disposed along a substantially identical radius and on the same peripheral wall, light sources 74A are staggered in relation to light sources 74B by approximately one-half of the distance between adjacent light sources 74A and 74B. So constructed, the animation device 66 can provide animation images 100 during rotation of the body portion 68 as depicted in FIG. 28 that have resolution including distinct paths of light established by the light sources 74A and 74B.

The foregoing embodiment will make clear that, within the scope of the invention except as it might expressly be limited, rows of light sources, such as those indicated at 56A, 56B, 74A, and 74B, could be disposed substantially to a single side of a pivot axis 54 and 76 and staggered. The light sources 56A, 56B, 74A, and 74B could be disposed in parallel but staggered rows.

It has been appreciated that application of the animation devices and methods disclosed herein to tops and other manually-operated display devices 66 poses a challenge. Whether spun by hand, by a pre-wound pull string, by a zip-cord, a spring-loaded launcher, or some other method, tops and similar devices start fast and continuously slow down until they wobble and fall over. The challenge is to create an animation 100 that generally maintains its relative position while spinning from start to stop.

Solutions contemplated hereunder include accelerometer and centrifugal or centripetal switches. For example, a sensor capable of measuring force along at least one axis can be positioned to sense the centrifugal or centripetal force. An accelerometer can output a "continuum" of values, or a contact-switch can be employed that is closed thereby to be conducting above a certain acceleration and open thereby to be non-conducting below that acceleration. A rate can be experimentally measured that corresponds to the rotational frequency when the sensor experiences a reference acceleration. Where an accelerator chip and a compass are employed, the accelerator chip can govern the flash rate for the animation frames and the compass can keep the image in a given orientation.

During rotation of the device 66, the light sources 56A, 56B, 74A, and 74B will be energized in the sequence of bit-patterns from electronic memory or real-time graphics software. The rate of playback of the images 100 is a function of the estimated angular velocity of the device 66. For example, the estimated angular velocity can be the initial velocity, which can be measured or estimated, minus some experimentally or mathematically derived decrease of angular velocity as a function of time and friction. In certain embodiments, the light sources 56A, 56B, 74A, and 74B can be deactivated after the estimated angular velocity drops below some predetermined level.

Embodiments are contemplated where the animation device 66 would have software and memory pre-calibrated to play the animations 100 in concert with the expected slowing of the animation device 66. By way of example, to maintain animation cadence, the frame rate could increase per revolution as the animation device 66 slows. The software and memory could be calibrated knowing, for example, the size and weight of the animation device 66 and what method would be used to induce rotation. Assumptions can be made that the device 66 will slow down and topple within the same general period of time.

A centrifugal switch can have two contacts that are normally separated but that are brought together by sufficient centrifugal force. This switch could be pre-adjusted to have the contacts close on launching at an expected angular velocity. The switch can open when the rotating device 66 slows to a predetermined speed thereby causing the animation program to begin. The program can be timed and calibrated to keep the subject animating at the same general cadence and, to the extent desired, in the same general fixed position until approximately when the device 66 starts to wobble and fall. The program can then turn off, reset, and wait until the device 66 is spun again.

An even further rotatable animation device 78 according to the invention is depicted in FIGS. 29 and 30. There, a three-dimensional animation device 78 is capable of providing a sphere 84 of animation by use of a rotatable member 80, which again can comprise a disk, a bar, a fan with blades, or any other structure, whether unitary or in multiple pieces. Here, however, the member 80 is rotatable, whether manually, by motor, or by any other force to have dual, perpendicular axes of rotation X and Y. A plurality of light sources 82A are disposed to a first side of the axis of rotation 84, and a plurality of light sources 82B are disposed to a second side of the axis of rotation 84. The light sources 82A retained to the first side of the axis of rotation 84 are staggered in relation to the light sources 82B disposed to the second side of the axis of rotation 84 such that the light sources 82A follow different paths of illumination from the light sources 82B.

The number of light sources 82A retained to the first side of the axis of rotation 84 equals the number of the light sources 82B disposed to the second side of the axis of rotation 84. Again, that need not be the case except as the invention may be expressly limited. As used in relation to this animation device 78, the terms stagger, staggered, or the like shall mean to have different radii from corresponding light sources 82A or 82B to opposite sides of the axis of rotation 84. In the example depicted in FIGS. 29 and 30, for example, the light sources 82A and 82B are substantially evenly spaced and are staggered by a distance of approximately one-half of the distance between adjacent light sources 82A and 82B.

With the light sources 82A and 82B so disposed, the light sources 82A will establish different paths of illumination from the paths of illumination established by the light sources 82B as described and shown previously. The paths of illumination established by the light sources 82A are interposed between the paths of illumination established by the light sources 82B. Under this construction, a sphere 84 of illumination formed by the several paths of illumination can be created by simultaneous rotation of the rotatable member 80 about axes X and Y, and three-dimensional volumetric animation can be achieved by selective actuation of the light sources 82A and 82B. The distinct light paths established by the light sources 82A and 82B allow each light source 82A and 82B to contribute its own annular ring or portion or portions of an annular ring of light to the sphere 84 and any resulting three-dimensional image formed therewithin.

With certain details and embodiments of the present invention for two-dimensional and three-dimensional animation with staggered illumination sources disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. An illuminated animation device with staggered sources of illumination, the animation device comprising:

a rotatable member rotatable about an axis of rotation wherein the rotatable member has a left portion to a first side of the axis of rotation, a right portion to a second side of the axis of rotation, and a longitudinal height along the axis of rotation;

a first plurality of sources of illumination retained to rotate with the rotatable member;

a second plurality of sources of illumination retained to rotate with the rotatable member;

wherein the first and second pluralities of sources of illumination are actuatable between illuminated and non-illuminated conditions;

wherein the first plurality of sources of illumination are retained in a substantially evenly spaced array entirely disposed to a first side of the axis of rotation retained by the left portion of the rotatable member with each source of illumination of the first plurality of sources of illumination spaced at a given radius from the axis of rotation, wherein the second plurality of sources of illumination are retained in a substantially evenly spaced array entirely disposed to a second side of the axis of rotation retained by the right portion of the rotatable member with each source of illumination of the second plurality of sources of illumination spaced at a given radius from the axis of rotation, wherein interstitial spaces without sources of illumination are disposed between the sources of illumination of the array of the first plurality of sources of illumination, wherein interstitial spaces without sources of illumination are disposed between the sources of illumination of the array of the second plurality of sources of illumination, wherein each of the first plurality of sources of illumination is disposed to align along a circumference concentric with the axis of rotation with an interstitial space between the sources of illumination of the second plurality of light sources, and wherein each of the second plurality of sources of illumination is disposed to align along a circumference concentric with the axis of rotation with an interstitial space between the sources of illumination of the first plurality of light sources, and wherein all of the sources of illumination of the first plurality of sources of illumination are disposed at different longitudinal heights in relation to the axis of rotation than all of the sources of illumination of the second plurality of sources of illumination;

whereby, when the rotatable member is rotated and the sources of illumination are actuated, the sources of illumination will produce paths of illumination and whereby the paths of illumination produced by the first plurality of sources of illumination are staggered in relation to the paths of illumination produced by the second plurality of sources of illumination and whereby illuminated images can be displayed by the illuminated animation device with a resolution deriving from the separate and distinct paths of illumination of the first and second pluralities of sources of illumination.

2. The illuminated animation device of claim 1 wherein the rotatable member comprises a rotatable panel with a longitudinal axis of rotation, a first left panel half to one side of the longitudinal axis of rotation, and a second right panel half to a second side of the longitudinal axis of rotation, wherein the first plurality of sources of illumination are retained in a longitudinally and radially, substantially evenly spaced array by the first left panel half, and wherein the second plurality of sources of illumination are retained in a longitudinally and radially, substantially evenly spaced array by the second right panel half whereby the illuminated animation device can produce three-dimensional images and animation by a rotation of the rotatable panel in combination with an actuation of the first and second pluralities of sources of illumination.

3. The illuminated animation device of claim 2 wherein the array of the first plurality of sources of illumination is radially staggered in relation to the array of the second plurality of sources of illumination.

4. The illuminated animation device of claim 1 wherein the first plurality of sources of illumination are retained in a longitudinally and radially spaced array and wherein the second plurality of sources of illumination are retained in a longitudinally and radially spaced array wherein each of the first plurality of sources of illumination is disposed to align radially and longitudinally along a circumference concentric with the axis of rotation with an interstitial space between the sources of illumination of the second plurality of light sources, and wherein each of the second plurality of sources of illumination is disposed to align radially and longitudinally along a circumference concentric with the axis of rotation with an interstitial space between the sources of illumination of the first plurality of light sources whereby the illuminated animation device can produce three-dimensional images and animation by a rotation of the rotatable member in combination with an actuation of the first and second pluralities of sources of illumination.

5. The illuminated animation device of claim 4 wherein the array of the first plurality of sources of illumination is disposed substantially in diametric opposition to the array of the second plurality of sources of illumination.

6. The illuminated animation device of claim 4 wherein the first plurality of sources of illumination is approximately equal in number to the second plurality of sources of illumination.

7. The illuminated animation device of claim 4 wherein the array of the first plurality of sources of illumination is disposed in a pattern that substantially matches a pattern in which the array of the second plurality of sources of illumination is disposed.

8. The illuminated animation device of claim 7 wherein the arrays of the first and second pluralities of sources of illumination are staggered in radial and longitudinal positions by approximately one-half a distance between adjacent sources of illumination.

9. The illuminated animation device of claim 1 wherein the first plurality of sources of illumination are retained in a radially spaced array and wherein the second plurality of sources of illumination are retained in a radially spaced array whereby the illuminated animation device can produce two-dimensional images and animation by a rotation of the rotatable member in combination with an actuation of the first and second pluralities of sources of illumination.

10. The illuminated animation device of claim 9 wherein the array of the first plurality of sources of illumination is disposed substantially in diametric opposition to the array of the second plurality of sources of illumination.

11. The illuminated animation device of claim 9 wherein the arrays are staggered in radial position by approximately one-half a distance between adjacent sources of illumination whereby the paths of illumination established by the first plurality of sources of illumination are interposed between the paths of illumination established by the second plurality of sources of illumination.

12. The illuminated animation device of claim 11 wherein the pluralities of sources of illumination are disposed in arrays of substantially straight lines.

13. The illuminated animation device of claim 9 wherein the rotatable member comprises a manually rotatable top with a rotatable body portion and a tip wherein the first and second pluralities of sources of illumination are retained by the body portion of the top.

14. The illuminated animation device of claim 1 further comprising a motor for rotating the rotatable member and a power source for powering the motor.

15. The illuminated animation device of claim 1 wherein the rotatable member is rotatable about first and second axes of rotation and wherein the first plurality of sources of illumination are retained in a radially spaced array and wherein the second plurality of sources of illumination are retained in a radially spaced array whereby the illuminated animation device can produce three-dimensional volumetric images and animation by a rotation of the rotatable member about the first and second axes of rotation in combination with an actuation of the first and second pluralities of sources of illumination.

16. The illuminated animation device of claim 1 wherein the illuminated animation device is handheld with a handle portion that rotatably retains the rotatable member and further comprising a motor for rotating the rotatable member and a power source for powering the motor.

17. The illuminated animation device of claim 16 wherein the rotatable member comprises a rotatable panel with a longitudinal axis of rotation, a first left panel half to one side of the longitudinal axis of rotation, and a second right panel half to a second side of the longitudinal axis of rotation, wherein the first plurality of sources of illumination are retained by the first left panel half, wherein the second plurality of sources of illumination are retained by the second right panel half whereby the illuminated animation device can produce three-dimensional images and animation by a rotation of the rotatable panel in combination with an actuation of the first and second pluralities of sources of illumination, wherein the rotatable panel has arrays of apertures entirely therethrough, and wherein the sources of illumination are retained in the apertures in the rotatable panel.

18. The illuminated animation device of claim 17 further comprising a user control interface for permitting selective control of the rotation of the rotatable member, the illumination of the sources of illumination, and the animation speed of three-dimensional animation displayed by the animation device.

19. The illuminated animation device of claim 18 further comprising a power circuit board retained by the handle portion, a display circuit board retained to rotate with the rotatable member, rotary electrical interfaces for transmitting power and control signals between the power circuit board and the display circuit board, a memory chip retained to rotate with the rotatable member, a data connector in electrical communication with the memory chip for loading data files onto the memory chip, and a programming connector retained to rotate with the rotatable member to permit a programming of the display circuit board.

20. The illuminated animation device of claim 18 further comprising means for adjusting the brightness of the sources of illumination dependent on a distance of the source of illumination from the axis of rotation.

21. An illuminated animation device with staggered sources of illumination, the animation device comprising:

a rotatable member rotatable about an axis of rotation wherein the rotatable member has a first portion to a first side of the axis of rotation, a second portion to a second side of the axis of rotation, and a longitudinal height along the axis of rotation;

a first plurality of sources of illumination retained to rotate with the rotatable member wherein the first plurality of sources of illumination are retained entirely by the first portion of the rotatable member in a longitudinally and laterally, substantially evenly spaced array to a first side of the axis of rotation and wherein interstitial spaces without sources of illumination are disposed between the sources of illumination of the array of the first plurality of sources of illumination;

a second plurality of sources of illumination retained to rotate with the rotatable member wherein the second plurality of sources of illumination are retained entirely by the second portion of the rotatable member in a longitudinally and laterally, substantially evenly spaced array to a second side of the axis of rotation and wherein interstitial spaces without sources of illumination are disposed between the sources of illumination of the array of the second plurality of sources of illumination;

wherein the first plurality of sources of illumination are radially and longitudinally staggered in relation to the second plurality of sources of illumination with all of the sources of illumination of the first plurality of sources of illumination disposed at different longitudinal heights than all of the sources of illumination of the second plurality of sources of illumination and wherein each of the first plurality of sources of illumination is disposed to align radially and longitudinally along a circumference concentric with the axis of rotation with an interstitial space between the sources of illumination of the second plurality of light sources, and wherein each of the second plurality of sources of illumination is disposed to align radially and longitudinally along a circumference concentric with the axis of rotation with an interstitial space between the sources of illumination of the first plurality of light sources;

wherein the first and second pluralities of sources of illumination are actuatable between illuminated and non-illuminated conditions;

whereby, when the rotatable member is rotated and the sources of illumination are actuated, the sources of illumination will produce paths of illumination and whereby the paths of illumination produced by the first plurality of sources of illumination are staggered in relation to the paths of illumination produced by the second plurality of sources of illumination and whereby illuminated images can be displayed by the illuminated animation device with a resolution deriving from separate and distinct paths of illumination of the first and second pluralities of sources of illumination.

22. The illuminated animation device of claim 21 wherein the arrays of the first and second pluralities of sources of illumination are substantially symmetrical.

23. The illuminated animation device of claim 22 wherein the first plurality of sources of illumination is approximately equal in number to the second plurality of sources of illumination.

24. The illuminated animation device of claim 21 wherein the array of the first plurality of sources of illumination is disposed in a substantially symmetrical pattern, wherein the array of the second plurality of sources of illumination is disposed in a substantially symmetrical pattern, and wherein the pattern of the first plurality of sources of illumination substantially matches the array of the second plurality of sources of illumination.

25. The illuminated animation device of claim 24 wherein the arrays of the first and second pluralities of sources of illumination are staggered in radial and longitudinal positions by approximately one-half a distance between adjacent sources of illumination.

* * * * *